US012716639B2

(12) United States Patent
Lydick et al.

(10) Patent No.: US 12,716,639 B2
(45) Date of Patent: Aug. 25, 2026

(54) COLD STORAGE SYSTEMS

(71) Applicant: Trane Technologies Life Sciences LLC, Davidson, NC (US)

(72) Inventors: Trace A. Lydick, Athens, OH (US); Alex Roberts, Parkersburg, WV (US); Thomas A. Schoeppner, Marietta, OH (US); Benjamin T. Irwin, Marietta, OH (US); Mitchell J. Donnelly, Williamstown, WV (US); Luke Schlicher, Marietta, OH (US)

(73) Assignee: Trane Technologies Life Sciences LLC, Davidson, NC (US)

( * ) Notice: Subject to any disclaimer, the term of this patent is extended or adjusted under 35 U.S.C. 154(b) by 194 days.

(21) Appl. No.: 18/585,852

(22) Filed: Feb. 23, 2024

(65) Prior Publication Data

US 2025/0271198 A1 Aug. 28, 2025

(51) Int. Cl.

| | |
|---|---|
| ***F25D 17/08*** | (2006.01) |
| ***F25D 17/06*** | (2006.01) |
| ***F25D 23/02*** | (2006.01) |

(52) U.S. Cl.

CPC ..... *F25D 17/08* (2013.01); *F25D 17/067* (2013.01); *F25D 23/028* (2013.01);
(Continued)

(58) Field of Classification Search

CPC ..... F25D 17/08; F25D 17/067; F25D 23/028; F25D 2400/36; F25D 2600/04;
(Continued)

(56) References Cited

U.S. PATENT DOCUMENTS

| | | | |
|---|---|---|---|
| 5,553,997 | A | 9/1996 | Goshaw et al. |
| 5,797,729 | A | 8/1998 | Rafuse, Jr. et al. |

(Continued)

FOREIGN PATENT DOCUMENTS

| | | |
|---|---|---|
| EP | 0227504 B1 | 9/1989 |
| EP | 1443289 A1 | 8/2004 |

(Continued)

OTHER PUBLICATIONS

Merkushev, "Status notification led—Home Assistant," Mar. 2, 2022, 21 pages, https://brushknight.medium.com/status-notification-led-home-assistant-2eb800506ce2.

(Continued)

*Primary Examiner* — Cassey D Bauer

(74) *Attorney, Agent, or Firm* — Womble Bond Dickinson (US) LLP

(57) ABSTRACT

An embodiment of a cold storage system includes a housing further including a chamber having a front opening closeable by an outer door and a back wall opposite the front opening, one or more outlets defined in the back wall, and one or more inlets defined in the chamber more proximate the front opening than the back wall. In addition, the cold storage system includes a refrigeration module operably coupled to the chamber. The refrigeration module includes an evaporator positioned vertically higher than the chamber, a blower configured to generate an airflow that is in thermal communication with the evaporator, and ducting configured to circulate the airflow between the chamber and the evaporator via the inlets and the outlets such that the airflow is directed through the outlets into the chamber and then from the chamber into the inlets to cool the chamber.

19 Claims, 25 Drawing Sheets

(52) U.S. Cl.
CPC ..... *F25D 2400/36* (2013.01); *F25D 2600/04* (2013.01); *F25D 2700/121* (2013.01)

(58) Field of Classification Search
CPC ..... F25D 2700/121; F25D 19/02; F25D 2323/02; F25D 23/087; F25D 25/02; F25B 7/00
See application file for complete search history.

(56) References Cited

U.S. PATENT DOCUMENTS

| | | | |
|---|---|---|---|
| 5,921,092 | A | 7/1999 | Behr et al. |
| 6,058,723 | A | 5/2000 | Kusunoki et al. |
| 6,324,856 | B1 | 12/2001 | Weng |
| 6,557,358 | B2 | 5/2003 | Weng et al. |
| 6,574,978 | B2 | 6/2003 | Flynn et al. |
| 6,766,652 | B2 | 7/2004 | Kelly et al. |
| 8,011,191 | B2 | 9/2011 | Wang et al. |
| 8,020,389 | B2 | 9/2011 | Ascani |
| 8,448,459 | B2 | 5/2013 | McSweeney et al. |
| 8,590,327 | B2 | 11/2013 | Tobe et al. |
| 8,826,677 | B2 | 9/2014 | Clodic et al. |
| 9,021,823 | B2 | 5/2015 | Caillat |
| 9,239,174 | B2 | 1/2016 | Rockenfeller et al. |
| 9,429,347 | B2 | 8/2016 | Sugimoto et al. |
| 9,476,625 | B2 | 10/2016 | McSweeney |
| 9,494,354 | B2 | 11/2016 | McSweeney et al. |
| 9,541,907 | B2 | 1/2017 | McSweeney |
| 9,593,869 | B2 | 3/2017 | Asari et al. |
| 9,597,970 | B2 | 3/2017 | DeBoer, III et al. |
| 9,646,468 | B2 | 5/2017 | Smith et al. |
| 9,683,563 | B2 | 6/2017 | Caillat |
| 9,835,360 | B2 | 12/2017 | Wang et al. |
| 9,989,280 | B2 | 6/2018 | Ali |
| 10,072,876 | B2 | 9/2018 | Wang et al. |
| 10,254,016 | B2 | 4/2019 | Sata et al. |
| 10,760,825 | B2 | 9/2020 | Tamaoki et al. |
| 10,816,243 | B2 | 10/2020 | Wang et al. |
| 10,838,454 | B2 | 11/2020 | Salmon et al. |
| 10,845,097 | B2 | 11/2020 | Wang et al. |
| 10,962,009 | B2 | 3/2021 | Pham et al. |
| 11,137,185 | B2 | 10/2021 | Farrar et al. |
| 11,215,384 | B2 | 1/2022 | Bartlett et al. |
| 11,566,820 | B2 | 1/2023 | Yamawaki et al. |
| 11,927,380 | B2 | 3/2024 | Kawano et al. |
| 2007/0271936 | A1 | 11/2007 | Wakamoto et al. |
| 2009/0205344 | A1 | 8/2009 | Ascani |
| 2009/0235678 | A1 | 9/2009 | Taras et al. |
| 2011/0072836 | A1 | 3/2011 | Wang et al. |
| 2011/0138826 | A1 | 6/2011 | Lifson et al. |
| 2012/0204581 | A1 | 8/2012 | Kang et al. |
| 2015/0176866 | A1 | 6/2015 | Takayama et al. |
| 2017/0343276 | A1* | 11/2017 | Cheon ..... F25D 25/02 |
| 2018/0106523 | A1* | 4/2018 | Besore ..... G05B 19/042 |
| 2018/0347863 | A1 | 12/2018 | Tamaoki et al. |
| 2019/0242623 | A1* | 8/2019 | Chhajed ..... F25D 11/04 |
| 2022/0079823 | A1 | 3/2022 | Nahavandi et al. |
| 2022/0087446 | A1 | 3/2022 | Friend et al. |
| 2022/0366520 | A1 | 11/2022 | Sudman et al. |

FOREIGN PATENT DOCUMENTS

| | | | | |
|---|---|---|---|---|
| EP | 1674806 | A1 | 6/2006 | |
| EP | 1783445 | A1 | 5/2007 | |
| EP | 1869379 | B1 * | 1/2010 | ..... F25D 23/087 |
| EP | 2995885 | B1 | 4/2020 | |
| EP | 2522933 | B1 | 9/2020 | |
| GB | 2442241 | A | 4/2008 | |
| JP | 2008008593 | A | 1/2008 | |

OTHER PUBLICATIONS

A1 Medical Integration, "Over Door / Patient Status Light—White," 2023, 2 pages, https://a1props.com/product/over-door-patient-status-light-white/.

Elo Touch Solutions, Inc., "Status Light (Gen 1)," 2024, 5 pages, Elo® Official Website, https://www.elotouch.com/accessories-status-light-gen-1.html.

Emerson: "E2 Installation and Operation Manual for RX Refrigeration, BX HVAC, and CX Convenience Store 1 Controllers", Apr. 6, 2010 (Apr. 6, 2010), pp. 1-252, XP093291321, Retrieved from the Internet: URL:https://statichtpg.globalimageserver.com/_WP/img/docs/imos/coldzone/E2_User_Manual.pdf.

* cited by examiner

COLD STORAGE SYSTEMS

CROSS-REFERENCE TO RELATED APPLICATIONS

This application is related to U.S. application Ser. No. 18/585,725, entitled "COMPRESSOR CONTROL PROCESS FOR VARIABLE CASCADE REFRIGERATION SYSTEM," naming Thomas A. Schoeppner, Alex Roberts, and Trace A. Lydick as inventors, and naming Trane Technologies Life Sciences LLC as the Applicant), and U.S. application Ser. No. 18/585,642 entitled "DEFROST FAN CONTROL," naming Thomas A. Schoeppner, Alex Roberts, Trace A. Lydick, and Mitchell J. Donnelly as inventors, and naming Trane Technologies Life Sciences LLC as the Applicant). Each of these applications is being filed on the same day as the instant application, and the entire contents of each of these applications is hereby incorporated by reference.

BACKGROUND

Cold storage systems, such as refrigerators, freezers, and the like may be used to store goods or other materials at temperatures that are lower than ambient conditions. For life-science products and materials, such as vaccines, biological samples, or other related materials, it is paramount that a cold storage system maintain desired environmental parameters (such as temperature, relative humidity, etc.) to avoid degradation or spoiling.

Cold storage systems may achieve temperatures within an inner storage chamber thereof that are notably lower than the surrounding ambient environment. For instance, some low temperature cold storage systems may be designed to achieve and maintain so-called "ultra-low" temperatures. As a result, careful design of the features and assemblies of such a cold storage system is called for to ensure optimal performance and operating efficiency at such low temperatures.

BRIEF SUMMARY

Some embodiments disclosed herein are directed to a cold storage system. In some embodiments, the cold storage system includes a housing further including a chamber having a front opening that is closeable by an outer door and a back wall opposite the front opening, one or more outlets defined in the back wall, and one or more inlets defined in the chamber that are more proximate the front opening than the back wall. In addition, the cold storage system includes a refrigeration module operably coupled to the chamber. The refrigeration module includes an evaporator positioned vertically higher than the chamber, a blower that is configured to generate an airflow that is in thermal communication with the evaporator, and ducting that is configured to circulate the airflow between the chamber and the evaporator via the one or more inlets and the one or more outlets such that the airflow is directed through the one or more outlets into the chamber and then from the chamber into the one or more inlets to cool the chamber.

Some embodiments disclosed herein are directed to a method. In some embodiments, the method includes (a) generating an airflow with a blower of a refrigeration module operably coupled to a chamber of a cold storage system. In addition, the method includes (b) cooling the airflow with an evaporator of the refrigeration module, the evaporator being positioned vertically higher than the chamber. Further, the method includes (c) directing the airflow into the chamber through one or more outlets positioned along a back wall of the chamber, and then out of the chamber through one or more inlets defined in the chamber to cool the chamber, the back wall being opposite a front opening of the chamber, and the one or more inlets being positioned more proximate the front opening than the back wall.

Some embodiments disclosed herein are directed to a cold storage system. In some embodiments, the cold storage system includes a housing further including a chamber having a front opening. In addition, the housing includes a door jamb extending around the front opening, the door jamb further including a first door stop defining a first seal surface, and a second door stop defining a second seal surface that is adjacent to the first seal surface along an edge of the front opening. The second door stop is parallel to and discontinuous from the first door stop such that the first door stop and the second door stop are configured to thermally contract independently of one another. In addition, the cold storage system includes a refrigeration module that is configured to generate an airflow through the chamber to reduce a temperature of the chamber below −50° C. Further, the cold storage system includes an outer door that is configured to selectively close the front opening. The outer door having a door seal includes a plurality of sealing projections that is configured to engage with the door jamb such that a first portion of the sealing projections is configured to engage the first door stop and a second portion of sealing projections is configured to engage the second door stop.

Some embodiments disclosed herein are directed to a method. In some embodiments, the method includes (a) engaging a first seal surface of a first door stop of a door jamb extending at least partially around a front opening of a chamber of a cold storage system with a first portion of a plurality of sealing projections of a door seal coupled to an outer door. In addition, the method includes (b) engaging a second seal surface of a second door stop of the door jamb with a second portion of the plurality of sealing projections of the door seal, the second door stop being parallel to and adjacent the first door stop along an edge of the front opening, and the second door stop being discontinuous from the first door stop such that the first door stop and the second door stop are configured to thermally contract independently of one another. Further, the method includes (c) directing an airflow from a refrigeration module and through the chamber to cool the chamber below −50° C.

Some embodiments disclosed herein are directed to a cold storage system. In some embodiments, the cold storage system includes a housing further including a chamber having a front opening that is closeable by an outer door and a back wall opposite the front opening, one or more outlets defined in the back wall, and a suction duct having one or more inlets defined therein that is positioned in an upper portion of the chamber, the suction duct at least partially formed by a tray that is removably inserted into the chamber from the front opening. In addition, the cold storage system includes a refrigeration module operably coupled to the chamber, the refrigeration module configured to generate an airflow that is directed out of the one or more outlets into the chamber and then from the chamber into the one or more inlets of the suction duct to cool the chamber below −50° C.

Some embodiments disclosed herein are directed to a method. In some embodiments, the method includes (a) inserting a tray into an upper portion of a chamber of a cold storage system to at least partially define a suction duct in the chamber. The tray has one or more inlets defined therein that are configured to place the chamber in fluid communication with the suction duct, and the chamber includes a back wall having one or more outlets defined therein. In addition, the method includes (b) operably coupling a refrigeration module to the chamber. The refrigeration module has a blower and an evaporator arranged such that the blower is configured to generate an airflow from the evaporator and into the chamber via the one or more outlets, and then from the chamber to the suction duct via the one or more inlets to cool the chamber below −50° C.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

A cold storage system may be used to store degradable materials, such as life science products and materials. Some cold storage systems are designed to achieve and maintain temperatures at or below −20° C., −50° C., −70° C., and in some cases be able to achieve, and maintain temperatures of −80° C. However, achieving and maintaining such low temperatures within a chamber that is otherwise surrounded by ambient, traditional room temperature, conditions may require careful design so as to ensure reliable and efficient operation.

Accordingly, embodiments disclosed herein are directed to cold storage systems that utilize forced air convection in an internal chamber to achieve and maintain low temperatures (e.g., such as ultra-low temperatures) for products stored therein. In some embodiments, the cold storage systems may utilize forced convection, via a refrigerated airflow through the chamber, to achieve and/or maintain the desired temperature therein. In some embodiments, the refrigeration system of the cold storage system may be configured and positioned to harness the upward flow of natural heat convection in the chamber so as to achieve enhanced operational efficiencies. In some embodiments, the cold storage systems may include enhanced door seals that are configured to withstand an extreme temperature difference between the interior of the cold chamber and the surrounding ambient environment, thereby also further enhancing performance and operational efficiency. In some embodiments, the cold storage systems may include alternative or additional features that may further increase reliability, performance, and/or efficiency thereof during operations. Thus, through use of embodiments disclosed herein, a cold storage system may more consistently and reliably achieve and maintain a desired temperature for stored products, which may be particularly important for degradable materials such as life science products.

Figure 1:
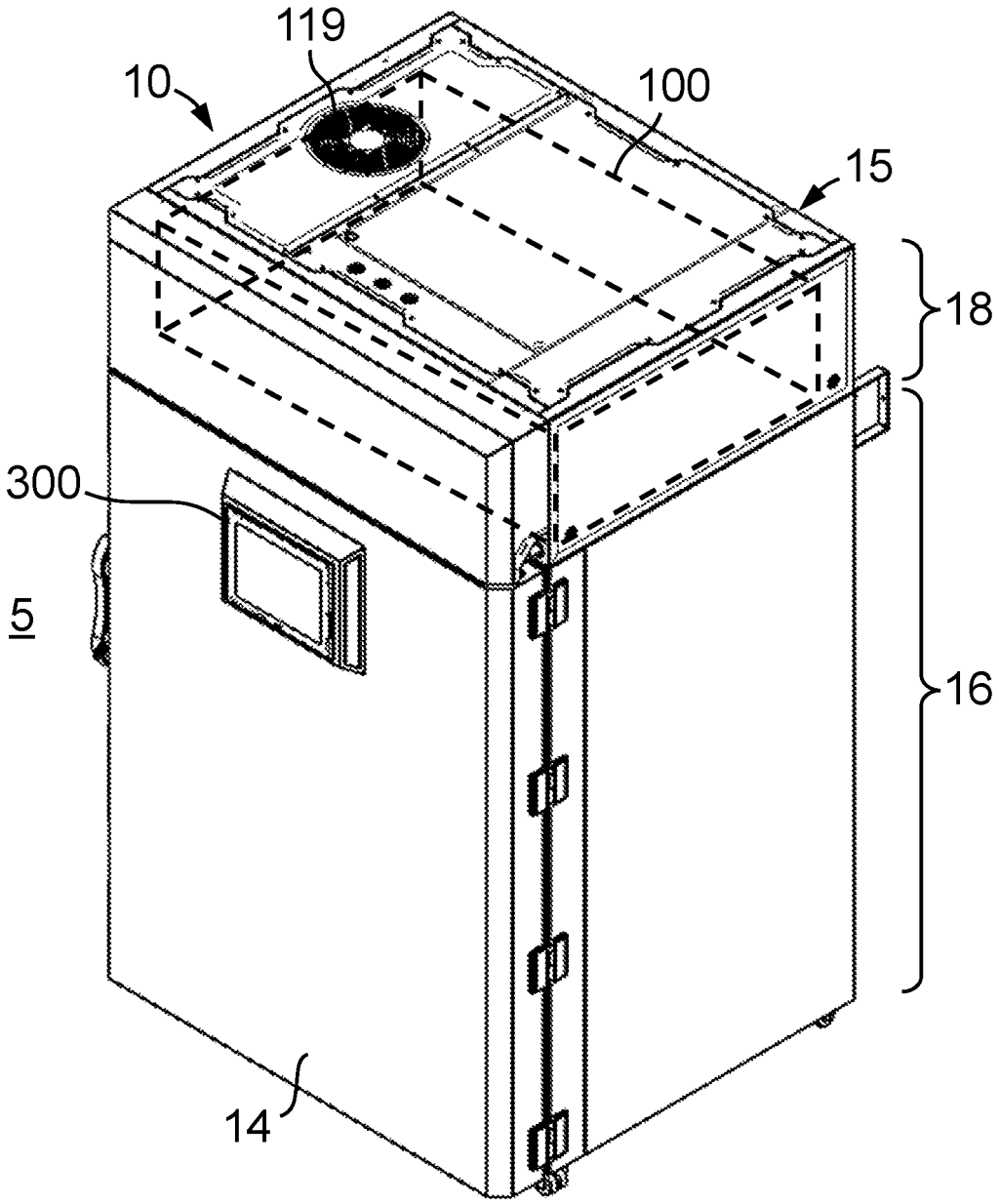
FIG. 1 is a perspective view of a cold storage system according to some embodiments disclosed herein.
Figure 2:
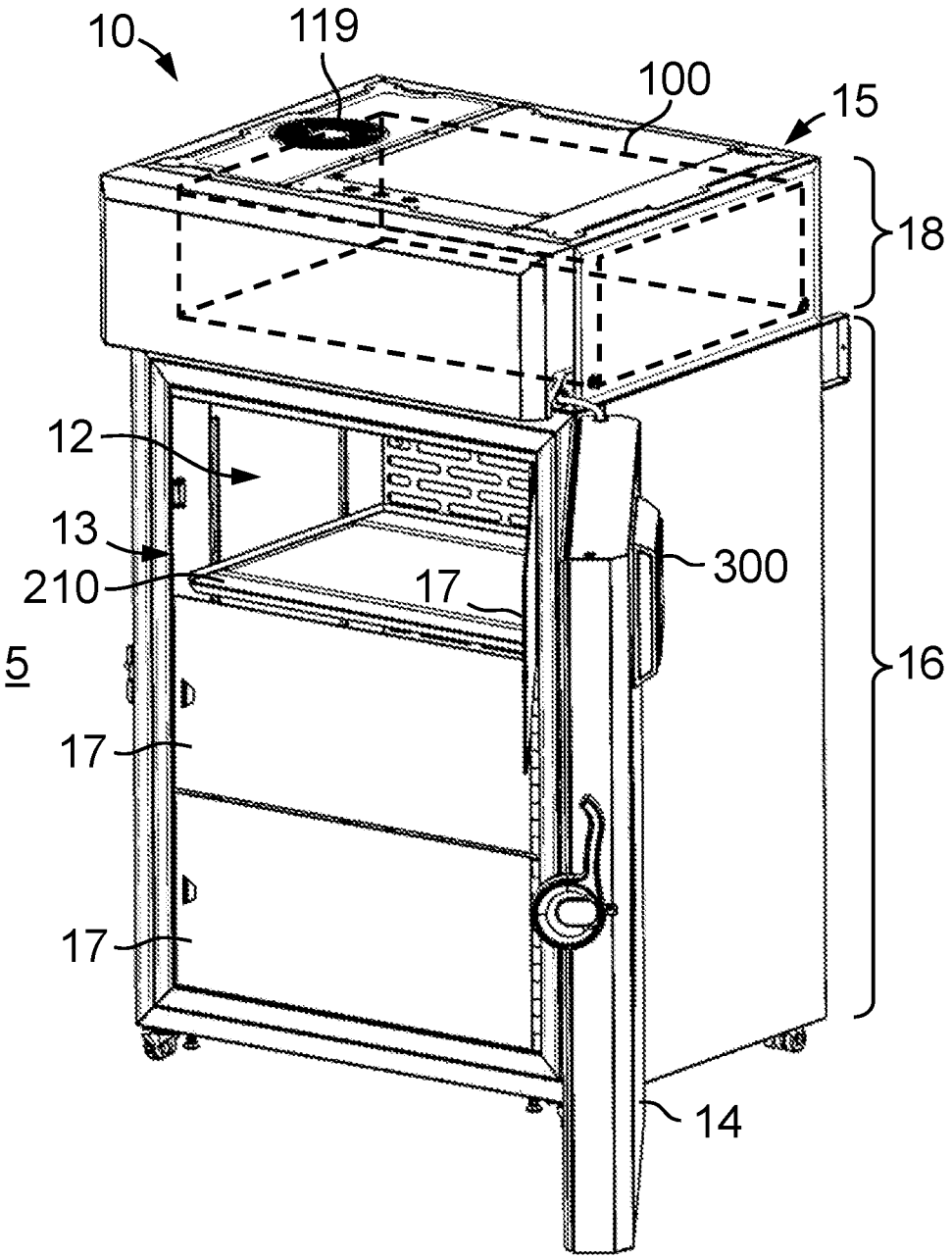
FIG. 2 is another perspective view of the cold storage system of FIG. 1, showing an outer door open to review an inner storage chamber therein according to some embodiments disclosed herein.
Figure 3:
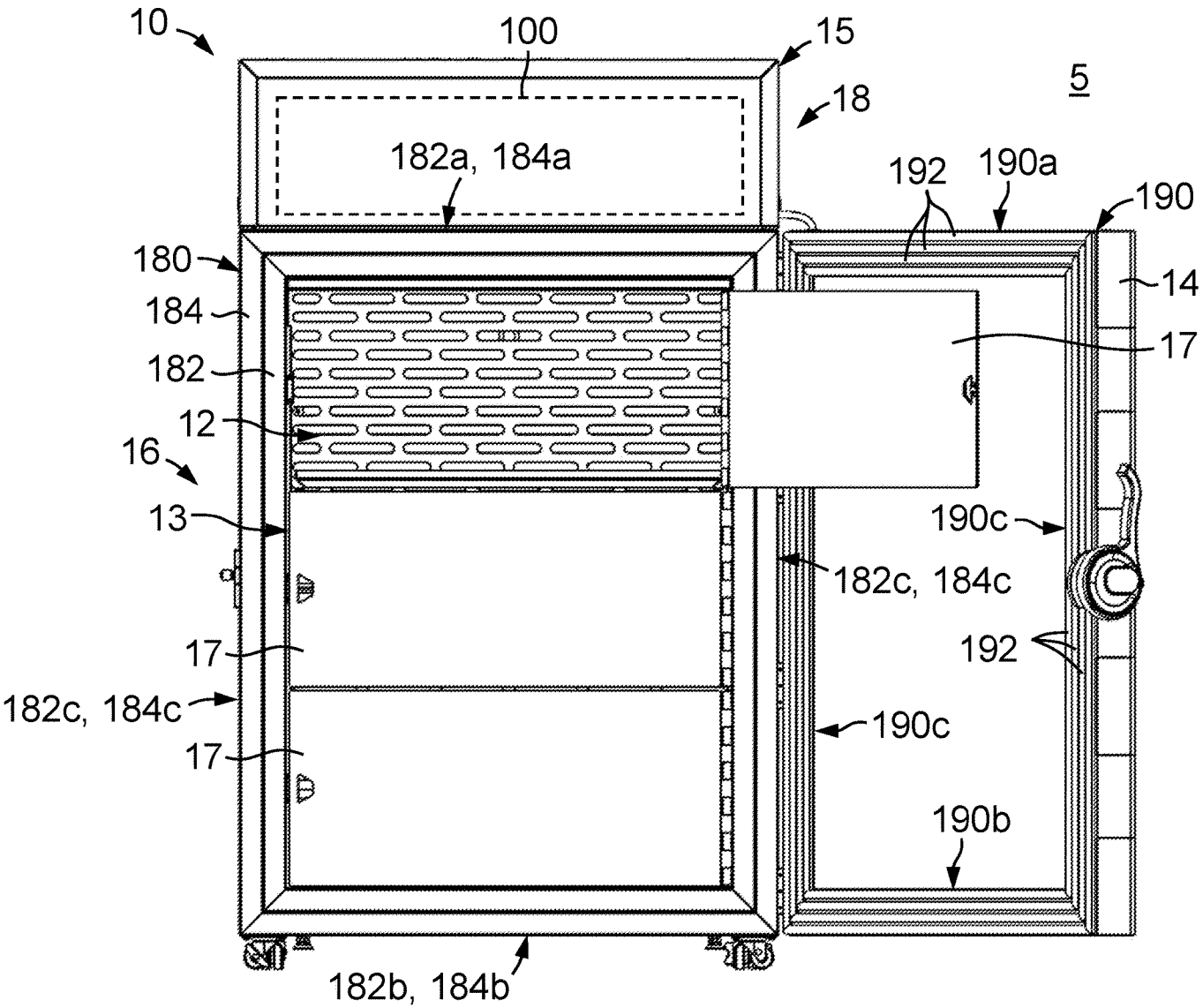
FIG. 3 is a front view of the cold storage system of FIG. 2 according to some embodiments disclosed herein.

Referring now to FIGS. 1-3, a cold storage system 10 according to some embodiments is shown. The cold storage system 10 may be configured to store degradable products (e.g., such as life-science products and materials) at temperatures below the freezing point of water (e.g., 0° C. or 32° F.) or lower (e.g., below −20° C., below −40° C., below −70° C., below −80° C., etc.). Thus, the cold storage system 10 may be more simply referred to herein as a "freezer." In some embodiment, the freezer may be configured to store products in "ultra-low temperatures" below −50° C. However, it should be appreciated that other embodiments of cold storage system 10 may be configured to store products at temperatures that are above the freezing point of water.

Generally speaking, the cold storage system 10 includes a housing 15 that defines one or more inner storage chambers 12 (or more simply "chamber" or "chambers") therein. The housing 15 may be relatively compact so that the cold storage system 10 may be transportable or relatively portable. Thus, the cold storage system 12 may be readily moved or transported between rooms in a facility or between different facilities entirely.

In the embodiment illustrated in FIGS. 2 and 3, the housing 15 includes a single chamber 12 that is accessible via an outer door 14. Specifically, the chamber 12 may include a front opening 13 that is closeable by the outer door 14 during operations. Thus, the chamber 12 is at least partially defined by the outer door 14. When the door 14 is closed to thereby occlude or cover the front opening 13 (FIG. 1), the chamber 12 is isolated or substantially closed-off from the surrounding environment 5, and when the door 14 is opened (FIGS. 2 and 3), the chamber 12 is exposed to the surrounding environment 5 via the front opening 13. In some embodiments, the cold storage system 10 may define a plurality of separate chambers 12 that may be accessible via the outer door 14 or a plurality of outer doors 14.

As shown in FIGS. 2 and 3, the chamber 12 may have one or more (e.g., a plurality of) inner doors 17 positioned therein that are configured to at least partially close the front opening 13 independently of the outer door 14. The one or more inner doors 17 may provide an additional barrier (that is, in addition to the outer door 14) to minimize air exchange between the chamber 12 and the ambient environment 5 when the outer door 14 is opened. The number and arrangement of inner doors 17 may correspond to the shelving or other organizational support structure (e.g., shelves 210) that is inserted within the chamber 12 so that a user may open an inner door 17 that is associated with a particular storage location (e.g., such as a particular shelf 210).

In addition, the cold storage system 10 includes a climate control assembly or system 100 that is operably coupled to the chamber 12. Specifically, the chamber 12 may be conditioned by a single climate control assembly 100 that is configured to achieve and/or maintain a desired temperature (or temperature range) within the chamber 12 during operations. The climate control assembly 100 may comprise a vapor compression refrigeration system or module (or more simply "refrigeration module") that circulates one or more refrigerants to exchange heat between the chamber 12 and environment 5 during operations. In some embodiments, the climate control assembly 100 may comprise a cascade refrigeration module that has a plurality of staged refrigerant circuits that are in thermal communication with one another and that are configured to achieve and/or maintain a low temperature within the chamber 12 during operations. Thus, the climate control assembly 100 may be referred to herein as a "refrigeration module" 100.

The housing 15 may define or include a first or upper portion 18 and a second or lower portion 16 that is positioned vertically below and lower than the upper portion 18. The refrigeration module 100 may substantially define the upper portion 18 and the chamber 12 may substantially define the lower portion 16. Thus, the refrigeration module 100 (or at least the majority thereof) may be positioned vertically higher and indeed vertically above the chamber 12. In some embodiments, the refrigeration module 100 (and/or at least a portion of the upper portion 18) may be readily removed and replaced on the lower portion 16 of housing 15 (e.g., so as to facilitate replacement of the refrigeration module 100 in the event of failure). Additional features of the chamber 12 and refrigeration module 100 are provided herein according to some embodiments.

In addition, in some embodiments, the position of the refrigeration module 100 relative to the chamber 12 and lower portion 16 of housing 15 may be varied. For instance, in some embodiments, the refrigeration module 100 (or a portion thereof) may be placed along a lateral side or back of the lower portion 16 of housing 15, or even potentially along a bottom side of the lower portion 16 of housing 15.

The freezer 10 may operate using electrical power supplied from a line power source (e.g., a local electrical grid). In addition, the freezer 10 may include (or be coupled to) one or more back-up batteries, capacitors, generators, etc. (collectively "back-up power sources"-not shown) to ensure freezer 10 (or one or more components or subs-systems thereof) remains operable in the event of a failure of the line power source. In some embodiments, the one or more back-up power sources may operate a user interface (e.g., user interface 300 described herein) and one or more sensors (e.g., temperature sensor 128) of freezer 10, but a remainder of the freezer 10 may become inoperable upon a loss or failure of the line power source.

Figure 4:
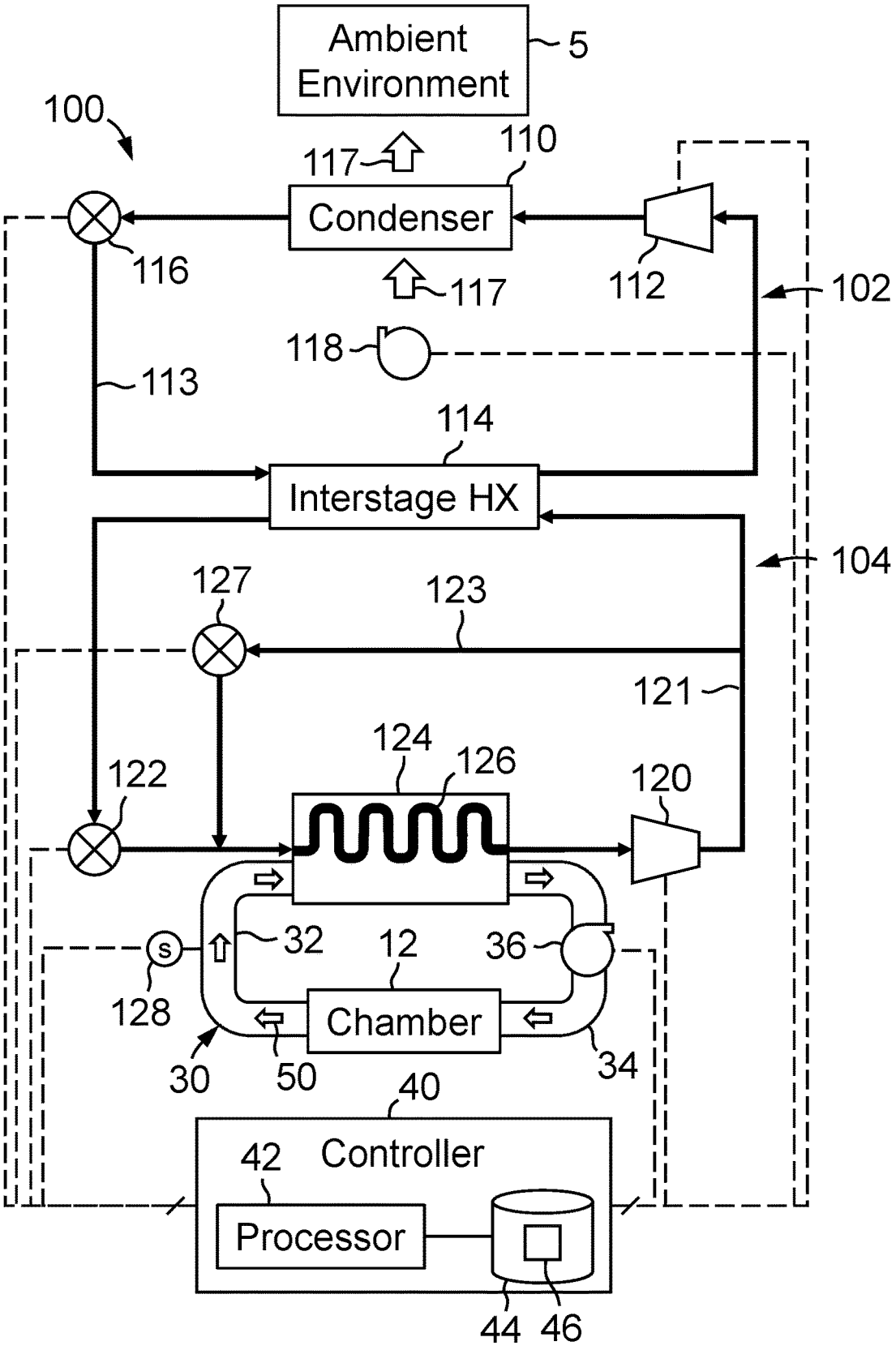
FIG. 4 is a schematic view of a climate control assembly of the cold storage system of FIG. 1 according to some embodiments disclosed herein.

FIG. 4 shows a schematic diagram of the refrigeration module 100 of freezer 10 according to some embodiments. As previously described, in some embodiments the refrigeration module 100 is configured circulate a refrigerant (or multiple refrigerants) to cool the chamber 12 during operations. In particular, the climate control assembly 100 may comprise a so-called cascade refrigeration module that includes a plurality of separate, staged refrigerant circuits 113, 121 that are thermally coupled to one another for transferring heat between the chamber 12 and the ambient environment 5. In some embodiments, the refrigeration module 100 may be configured to achieve and/or maintain low temperatures in the chamber 12 (e.g., such as "ultra-low" temperatures as previously described).

As shown in FIG. 4, the refrigeration module 100 may include a first refrigeration stage 102 (or more simply "first stage" 102) having a first refrigerant circuit 113 that circulates a first refrigerant, and a second refrigeration stage 104 (or more simply "second stage" 104) having a second refrigerant circuit 121 that circulates a second refrigerant. The first and second refrigerants may comprise any suitable refrigerant or combination of refrigerants such as, for instance one or more chlorofluorocarbons, hydrochlorofluorocarbons, hydrocarbons, ammonia, etc. The first and second refrigerants may be different from one another, and particularly may have different phase change temperatures. The first and second refrigerants may be selected so that at the operating pressures of the first and second refrigerant circuits 113, 121, the saturated condensing temperature range of the second refrigerant (in the second refrigerant circuit 121) overlaps with saturated evaporating temperature of the first refrigerant (in the first refrigerant circuit 113) in an interstage heat exchanger (e.g., the interstage heat exchanger 114 described herein) so that each of the first refrigerant and second refrigerant may experience a change in enthalpy when thermally interacting with one another during operations (e.g., via the interstage heat exchanger 114 described herein).

Generally speaking, during operations, the refrigeration module 100 may circulate the first and second refrigerants through the first and second refrigerant circuits 113, 121, respectively, in order to transfer heat from the chamber 12 to the ambient environment 5. Heat may be transferred between the first and second refrigerants via an interstage heat exchanger 114 that is coupled to and is a part of each of the first refrigerant circuit 113 and second refrigerant circuit 121.

More specifically, the first refrigerant circuit 113 may circulate the first refrigerant between a first stage compressor 112 (or more simply "compressor" 112), a condenser 110, a first stage expansion valve 116 (or more simply "expansion valve" or "valve" 116), and the interstage heat exchanger 114 in order to transfer heat from the second refrigerant circuit 121 to the ambient environment 5. Specifically, the compressor 112 may compress the first refrigerant and output the compressed first refrigerant to the condenser 110. The first refrigerant flowing to and through the compressor 112 may be in (or substantially in) a vapor state due to heat exchange within the interstage heat exchanger 114. The condenser 110 may comprise a heat exchanger (or collection of heat exchangers) that is configured to cool the first refrigerant by transferring heat from the first refrigerant to the ambient environment 5 via convection, radiation, and/or any other suitable mode of heat transfer. For instance, in the embodiment illustrated in FIG. 4, a blower or fan 118 may generate an airflow 117 that is in thermal contact with the first refrigerant via the condenser 110 so that during operations the first refrigerant transfers heat to the airflow 117 and cools, so as to condense or partially condense from a vapor into a liquid. The heated airflow 117 may flow outward and away from the condenser 110 and into the ambient environment 5. For instance, in some embodiments, the airflow 117 may exit the housing 15 at least partially out of a vent 119 positioned on a top or upper surface of the housing 15 (e.g., along a top or upper surface of the upper portion 18 of housing 15) as shown in FIGS. 1 and 2. In some embodiments, the condenser 110 may transfer heat from the first refrigerant to the ambient environment 5 via natural convection and/or radiation either in addition or in alternative to the forced convection via airflow 117. Accordingly, in some embodiments, the fan 118 may be omitted.

The liquid (or at least partially liquid) first refrigerant may be emitted from the condenser 110 and then expanded through the expansion valve 116 so as to at least partially vaporize and further cool the first refrigerant. Thereafter, the cooled first refrigerant is flowed into the interstage heat exchanger 114.

Figure 22:
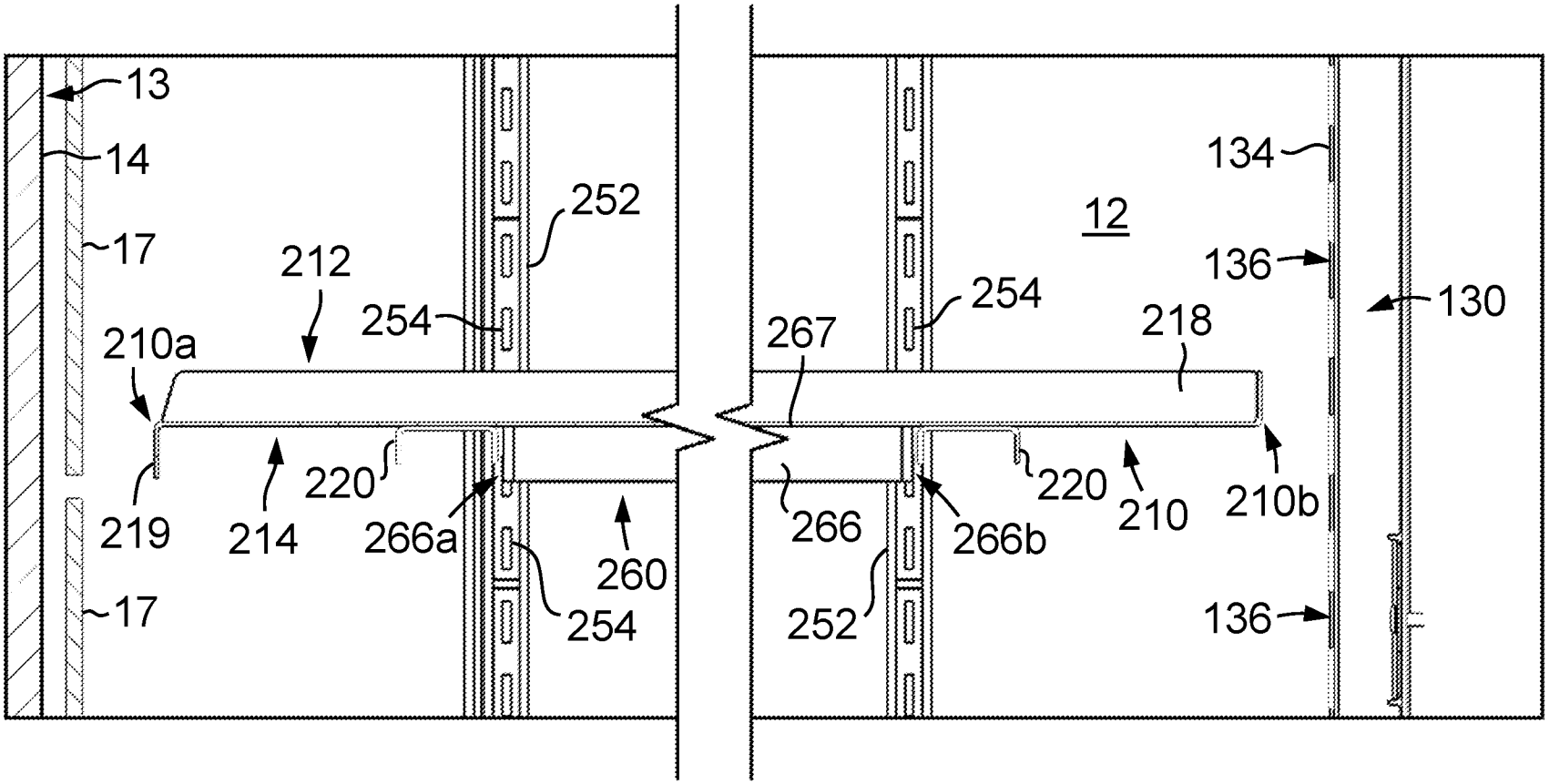

Within the interstage heat exchanger 114, heat is transferred from the second refrigerant flowing the second refrigerant circuit 121 to the first refrigerant so that the first refrigerant changes phase (or substantially changes phase) in the interstage heat exchanger 114 from a liquid to a vapor. Thus, the interstage heat exchanger 114 may function as an evaporator for the first refrigerant of the first refrigerant circuit 113. The heated and vaporized (or partially vaporized) first refrigerant is then emitted from the interstage heat exchanger 114 and flowed back to the first stage compressor 112 to restart the cycle described above. Further details of interstage heat exchanger 114 are described herein according to at least some embodiments of refrigeration module 100 (FIG. 22).

Referring still to FIG. 4, the second refrigerant circuit 121 may circulate the second refrigerant between a second stage compressor 120 (or more simply "compressor" 120), the interstage heat exchanger 114, a second stage expansion valve 122 (or more simply "expansion valve" or "valve" 122), and an evaporator 124, in order to transfer heat from the chamber 12 to the first refrigerant circuit 113. Specifically, the compressor 120 may compress the second refrigerant and output the compressed second refrigerant to the interstage heat exchanger 114. The second refrigerant flowing to and through the compressor 120 may be in (or substantially in) a vapor state due to heat exchange within the evaporator 124. Within the interstage heat exchanger 114, heat may be transferred from the second refrigerant to the first refrigerant as previously described. As a result, within the interstage heat exchanger 114, the second refrigerant may cool so as to condense or partially condense from a vapor into a liquid. Thus, the interstage heat exchanger 114 may function as a condenser for the second refrigerant of the first refrigerant circuit 121.

The liquid (or at least partially liquid) second refrigerant may be emitted from the interstage heat exchanger 114 and then expanded through the expansion valve 122 so as to at least partially vaporize and further cool the second refrigerant. Thereafter, the cooled second refrigerant is flowed into the evaporator 124.

The evaporator 124 is a heat exchanger that is configured to transfer heat from the chamber 12 to the second refrigerant. Specifically, the cooled second refrigerant is flowed through a coil 126 that is thermally exposed to an airflow 50 in the evaporator 124 (e.g., so that the airflow 50 is in thermal communication with the evaporator 124) so that heat is transferred from the airflow 50 to the second refrigerant to thereby cause the second refrigerant to change phase (or substantially change phase) from a liquid to a vapor. The airflow 50 may be generated by a blower or fan 36 that is in fluid communication with ducting 30 that is configured to direct the airflow 50 between the chamber 12 and evaporator 124 during operations. Specifically, the ducting 30 includes a suction duct 32 that is configured to direct the airflow 50 from the chamber 12 to the evaporator 124, and a discharge duct 34 that is configured direct the airflow 50 from the evaporator 124 to the chamber 12. The blower 36 may be positioned along or adjacent to the discharge duct 34; however, other positions for the blower 36 are contemplated herein (e.g., such as in the suction duct, in the chamber 12, etc.).

Referring still to FIG. 4, during operations, the refrigeration module 100 may substantially lower the temperature in the chamber 12. As previously described, the refrigeration module 100 may be configured to achieve and/or maintain ultra-low temperatures (e.g., below −50° C.) in the chamber 12, with the ambient environment 5 being maintained at normal indoor conditions (e.g., such as temperatures in a range of about 18-24° C. (about 65-75° F.) and relative humidity levels in a range of about 30-60% in some examples). In some embodiments, the ambient environment 5 may include temperatures that are less than normal indoor conditions (e.g., less than 18° C. or 65° F.), but may still be warmer than the temperature in the chamber 12. Air at temperatures warmer than that of the chamber 12 may also include greater relative humidity values than that found in the chamber 12. As a result, when the outer door 14 is opened, the relatively warm and humid air from the ambient environment 5 may flow into the substantially colder chamber 12 and eventually cause ice formation therein. Of particular note, the airflow 50 circulating between the evaporator 124 and the chamber 12 may lead to substantial ice formation on the coil 126 of the evaporator 124, which may degrade the heat transfer functionality of the evaporator 124. As a result, the refrigeration module 100 may periodically perform a defrost operation to remove ice that has accumulated on the coil 126. The defrost operation may include a so-called "hot gas bypass" and/or a separate supplemental heat source.

For instance, in some embodiments, the refrigeration module 100 may utilize a hot gas bypass to defrost the evaporator 124 during operations. Specifically, the second refrigerant circuit 121 may include a bypass line 123 that is configured to recycle compressed second refrigerant discharged from the compressor 120 back to the evaporator 124 in bypass of the interstage heat exchanger 114 and expansion valve 122. Specifically, a valve 127 may be positioned along the defrost bypass line 123 to control a flow of second refrigerant there along. During a defrost operation, the expansion valve 122 may be closed to prevent (or at least restrict) the flow of second refrigerant from the interstage heat exchanger 114 to the evaporator 124, and the valve 127 may be opened to initiate the flow of compressed and relatively warm second refrigerant from the compressor 120 back to the evaporator 124 to thereby melt ice that has accumulated on the coil 126.

In some embodiments, the refrigeration module 100 may defrost the coil 126 of the evaporator 124 via other methods. For instance, separate, supplemental heat sources (e.g., electrically resistive heating elements) may be positioned proximate to the coil 126 to melt accumulated ice. In some embodiments, the separate heat sources may comprise a heat generating assembly (e.g., a resistive heater or other suitable heating device or assembly) that is positioned outside of the enclosure 150 (e.g., such as attached to an outer surface of the housing 15), and the supplemental heat is delivered to the coil 126 via a conductive medium (e.g., a heat pipe, vapor chamber, etc.). As a result, in some embodiments, the defrost bypass line 123 may be omitted from the second refrigerant circuit 121. In other embodiments, particularly where a single refrigeration circuit is used, the circuit may be provided with a 3-way switch over valve to permit the direction of flow of refrigerant to reverse and resulting in the evaporator 124 acting like a condenser.

Performing a defrost operation may also require additional sources of heat to be added to the system and that result in warming the air surrounding the evaporator. For example, it is important that the ice that melts from the evaporator 124 is permitted to be collected and evacuated from the refrigeration assembly 100 prior to re-freezing. Therefore, in some embodiment a heater 129 (e.g., an electrically resistive heater) may be configured to warm a drain pan 131 positioned at least partially under the evaporator 124 (see FIG. 5) to keep the melted water from refreezing while it drains from the system. The heater 129 may be coupled to or integrated with the drain pan 131. As a consequence of the operation of heater 129, heat may be added to the air surrounding the coil 126.

A controller 40 may be communicatively coupled (via any suitable wired and/or wireless connection(s)) to various components of the refrigeration module 100 (e.g., compressors 112, 120, condenser 110, expansion valves 116, 122, valve 127, etc.). As described in more detail herein, the controller 40 may at least partially direct or control the operation of the refrigeration module 100 during operations. The controller 40 may be (or may be incorporated within) a main or master controller for the freezer 10, or the controller 40 may be a standalone controller 40 for controlling the refrigeration module 100 or a portion thereof. Regardless, the controller 40 may be described and referred to herein as being a part of the refrigeration module 100 and more broadly part of the freezer 10 (FIGS. 1-3).

The controller 40 may comprise one or more computing devices, such as a computer, tablet, smartphone, server, circuit board, or other computing device(s) or system(s). Thus, controller 40 may include a processor 42 and a memory 44.

The processor 42 may include any suitable processing device or a collection of processing devices. In some embodiments, the processor 42 may include a microcontroller, central processing unit (CPU), graphics processing unit (GPU), timing controller (TCON), scaler unit, or some combination thereof. During operations, the processor 42 executes machine-readable instructions (such as machine-readable instructions 46) stored on memory 44, thereby causing the processor 42 to perform some or all of the actions attributed herein to the controller 40. In general, processor 42 fetches, decodes, and executes instructions (e.g., machine-readable instructions 46). In addition, processor 42 may also perform other actions, such as, making determinations, detecting conditions or values, etc., and communicating signals. If processor 42 assists another component in performing a function, then processor 42 may be said to cause the component to perform the function.

The memory 44 may be any suitable device or collection of devices for storing digital information including data and machine-readable instructions (such as machine-readable instructions 46). For instance, the memory 44 may include volatile storage (such as random-access memory (RAM)), non-volatile storage (e.g., flash storage, read-only memory (ROM), etc.), or combinations of both volatile and non-volatile storage. Data read or written by the processor 42 when executing machine-readable instructions 46 can also be stored on memory 44. Memory 44 may include "non-transitory machine-readable medium," where the term "non-transitory" does not include or encompass transitory propagating signals.

The processor 42 may include one processing device or a plurality of processing devices that are distributed within (or communicatively coupled to) controller 40 or more broadly within refrigeration module 100 and/or freezer 10 (FIGS. 1-3). Likewise, the memory 44 may include one memory device or a plurality of memory devices that are distributed within (or communicatively coupled to) controller 40 or more broadly within refrigeration module 100 and/or freezer 10 (FIGS. 1-3). Thus, the controller 40 may comprise a plurality of individual "controllers" distributed throughout the climate control assembly 100 and/or freezer 10 (FIGS. 1-3).

The controller 40 may be communicatively coupled (e.g., via wired and/or wireless connection(s)) to one or more components of the refrigeration module 100. For example, as shown in FIG. 4, the controller 40 may be communicatively coupled to the compressors 112, 120, valves 116, 122, 127, blowers 118, 36, or some subset thereof. During operations, the controller 40 may control an operating condition of a component of the climate control assembly 100. For instance, the controller 40 may change an operating condition of one or both of the compressors 112, 120, and/or blowers 118, 36 such as by activating, deactivating, and/or changing an operating speed of one or both of the compressors 112, 120 and/or blowers 118, 36 during operations. Similarly, the controller 40 may change an operating condition of one or more of the valves 116, 122, 127 such as by changing a position thereof (e.g., open, closed, or some position therebetween). In some embodiments, the controller 40 may change an operating condition of one or both of the compressor 112, 120 and/or one or more of the valves 116, 122, 127 so as to achieve or maintain a desired temperature in the chamber 12.

In some embodiments, a temperature sensor 128 may be in fluid communication with the airflow 50. Specifically, the temperature sensor 128 may be positioned along the suction duct 32 (or elsewhere in the ducting 30 and/or chamber 12). Without being limited to this or any other theory, the airflow 50 entering the suction duct 32 may be heated due to contact with the chamber 12 (and products stored therein). As a result, the suction duct 32 may represent the location where the airflow 50 reaches its maximum average temperature during operations. Thus, placement of the temperature sensor 128 in the suction duct 32 may allow controller 40 to control the refrigeration module 100 based on a highest average temperature of the airflow 50 during operations. However, it should be appreciated that other locations for the temperature sensor 128 are contemplated herein, such as directly within the chamber 12, in the discharge duct 34, etc. In addition, in other embodiments, multiple temperature sensors (e.g., temperature sensor 128) may be positioned through the chamber 12, ducting 30, or elsewhere.

The controller 40 may be communicatively coupled to the temperature sensor 128 (or the multiple temperature sensors 128) and may be configured to control an operating condition of the refrigeration module 100 (or a component thereof) based at least in part on an output from the temperature sensor 128 during operations. For example, the controller 40 may activate or deactivate the refrigeration module 100 (or a portion thereof) based on an output from the temperature sensor 128. Specifically, the controller 40 may activate the compressors 112, 120 and blowers 36, 118 so as to circulate the first and second refrigerants through the first refrigerant circuit 113 and second refrigerant circuit 121, respectively, as previously described, at least partially in response to an output from the temperature sensor 128 that is indicative of a temperature in the suction duct 32 being above a target value. Conversely, the controller 40 may deactivate the compressors 112, 120 and blowers 36, 118 so as to cease circulation of the first and second refrigerant through the first refrigerant circuit 113 and second refrigerant circuit, respectively, as previously described at least partially in response to an output from the temperature sensor 128 that is indicative of a temperature in the suction duct 32 being below a target value. In addition, the controller 40 may adjust a position of the valves 116, 122 and/or or an operating speed of the compressors 112, 120 and/or blowers 36, 118 so as to actively change a cooling capacity of the refrigeration module 100 based at least in part on an output from the temperature sensor 128.

Figure 5:
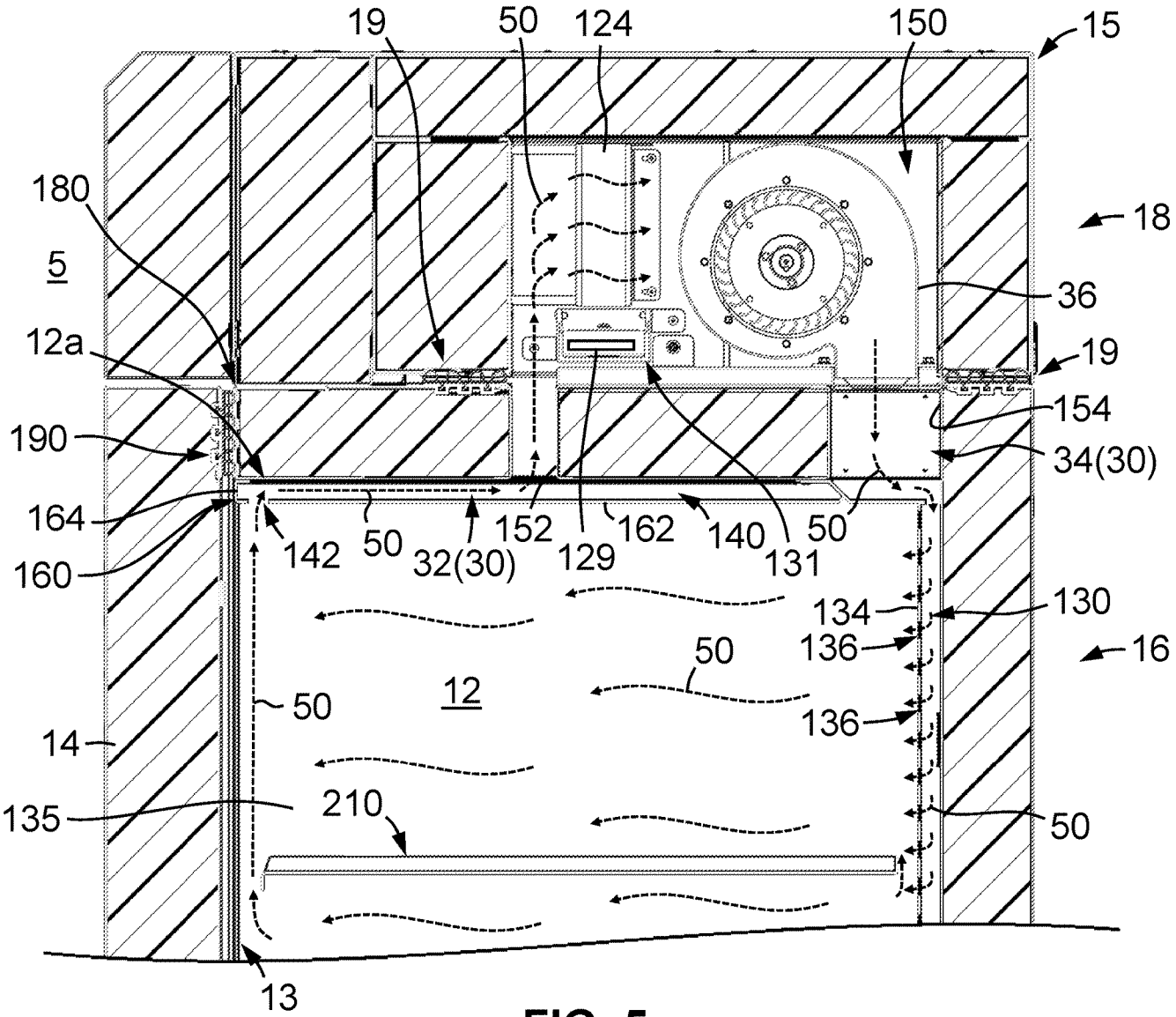
FIG. 5 is an enlarged, partial side cross-sectional view of the cold storage system of FIG. 1 illustrating an airflow between the inner storage chamber and an evaporator according to some embodiments disclosed herein.

FIG. 5 shows an example path for the airflow 50 through the chamber 12, ducting 30, and evaporator 124 (FIG. 4) according to some embodiments of freezer 10 (FIGS. 1-3). In particular, FIG. 5 shows a side cross-sectional view of the freezer 10—however, it should be noted that some features have been simplified or occluded by additional cross-hatching in order to simplify the drawing and to focus on the example path for the airflow 50 according to some embodiments. As shown in FIG. 5, the evaporator 124 and blower 36 may be co-located in an enclosure 150 that is formed in the upper portion 18 of housing 15. The enclosure 150 may be positioned vertically above the chamber 12. The enclosure 150 may substantially define the volume of air that would be heated as part of the defrost operation discussed above if the airflow 50 were stopped by deactivating the blower 36.

Figure 6:
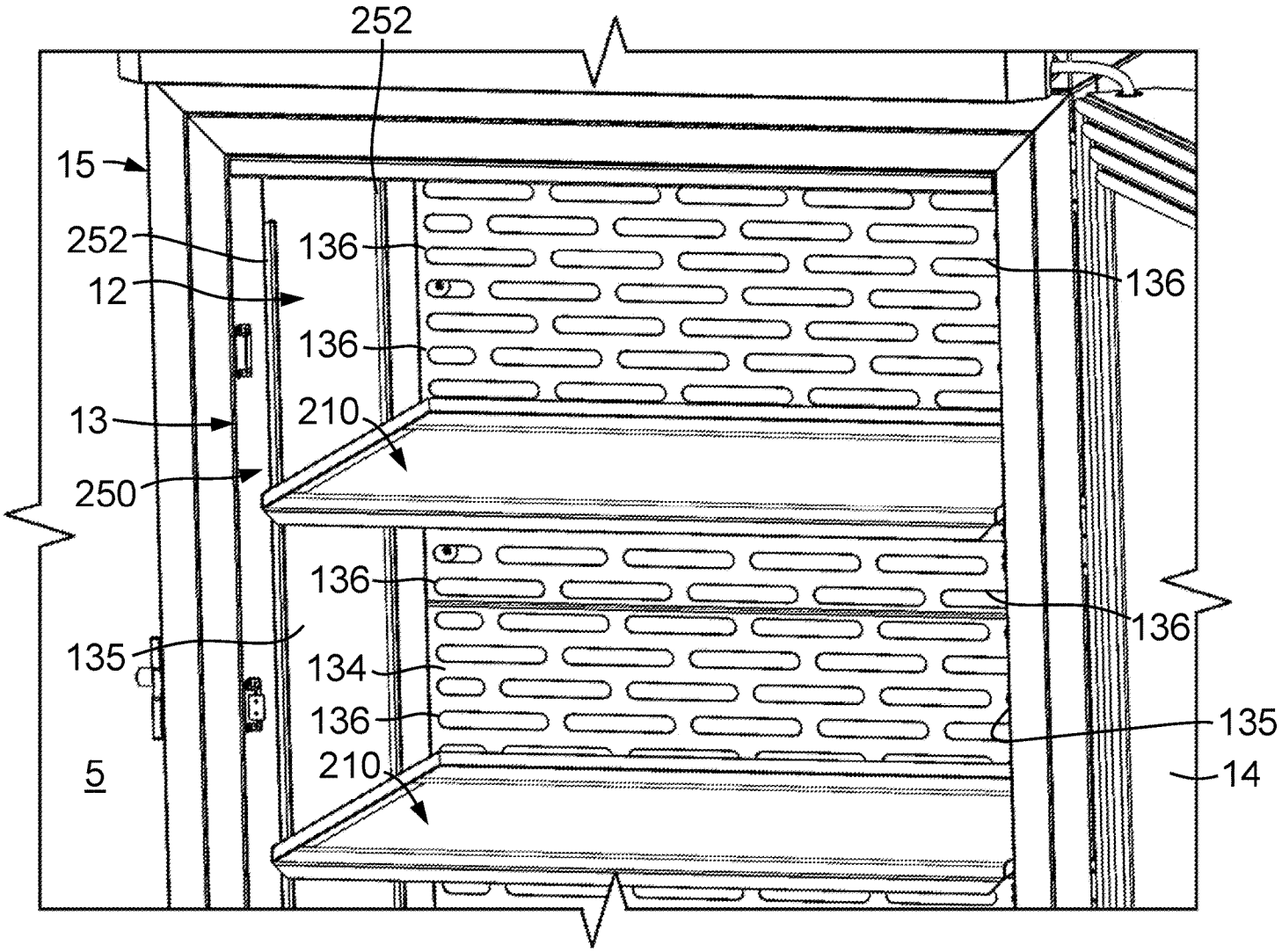
FIG. 6 is an enlarged, perspective view of the inner storage chamber of the cold storage system of FIG. 1 according to some embodiments disclosed herein.

The discharge duct 34 (of ducting 30) may include a discharge manifold 130 that is positioned adjacent to the chamber 12. Specifically, the chamber 12 may have a back wall 134 that is opposite the front opening 13 and that separates the discharge manifold 130 from the chamber 12. A pair of side walls 135 may extend laterally between the back wall 134 and the front opening 13 (only one of the side walls 135 is visible in the cross-section of FIG. 5). Thus, the discharge manifold 130 may be defined in the housing 15, behind a rear or back side of the chamber 12. The back wall 134 may include one or more (e.g., one or a plurality of) outlets 136 defined therein that are configured to place the chamber 12 in fluid communication with the discharge manifold 130 during operations. Referring briefly to FIG. 6, the plurality of outlets 136 may comprise a plurality of elongated slots that generally have an elongate pill shape that is elongated on the horizontal or lateral direction (e.g., substantially perpendicular to the direction of gravity). However, any suitable shape and arrangement of the outlets 136 is contemplated herein.

Figure 7:
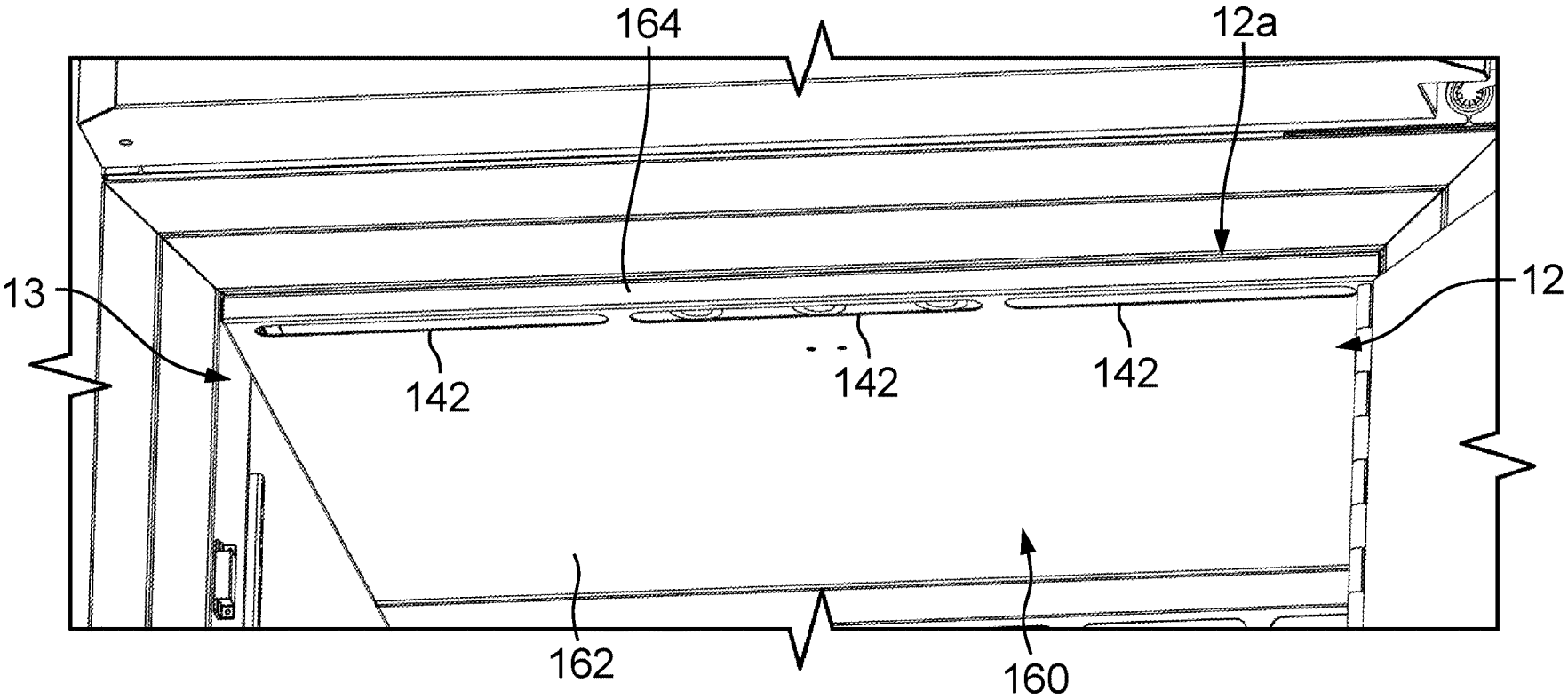
FIG. 7 is another enlarged, perspective view of the inner storage chamber of the cold storage system of FIG. 1 according to some embodiments disclosed herein.

Referring again to FIG. 5, the suction duct 32 (of ducting 30) may include a suction manifold 140 that is positioned at an upper end 12*a* of chamber 12. The upper end 12*a* of chamber 12 may be a vertically upper end (e.g., relative to the direction of gravity), and may comprise an end of the chamber 12 that is most proximate the enclosure 150 (and thus evaporator 124 and blower 36). The suction manifold 140 may be in fluid communication with the chamber 12 via one or more (e.g., one or a plurality of) inlets 142. The inlets 142 may thus be positioned in an upper portion of the chamber 12 that is proximate to the upper end 12*a*. In addition, the inlets 142 may be positioned more proximate the front opening 13 and door 14 than the back wall 134 in a lateral or horizontal direction within the chamber 12 (e.g., perpendicular to the direction of gravity). Referring briefly to FIG. 7, in some embodiments the inlets 142 may be similarly shaped to the plurality of outlets 136, and thus may be formed as elongated pill-shaped slots (however, as with outlets 136, other shapes are contemplated).

Referring again to FIG. 5, the suction manifold 140 may be in fluid communication with the enclosure 150 via a suction port 152, and the discharge manifold 130 may be in fluid communication with the enclosure 150 via a discharge port 154. Together, the suction manifold 140, suction port 152, and a first portion of the enclosure 150 (e.g., a portion upstream of the blower 36) may define the suction duct 32 of ducting 30, and the discharge manifold 130, discharge duct 154, and a second portion of the enclosure 150 (e.g., the portion including, and downstream of, the blower 36) may define the discharge duct 34 of ducting 30 as depicted in FIG. 4.

The arrangement of the manifolds 130, 140, outlets 136, and inlets 142 in the chamber 12 may facilitate a back-to-front and vertically upward flow direction for the airflow 50 in the chamber 12 during operations. Specifically, the blower 36 may discharge the airflow 50 vertically downward through the discharge port 154 and into the discharge manifold 130. Thereafter, the airflow 50 may flow out of the discharge manifold 130 and into the chamber 12 via the plurality of outlets 136. As shown in FIG. 5, the airflow 50 may change directions as it flows from discharge port 154 to the discharge manifold 130—specifically changing directions from vertical to lateral and then from lateral to vertical when flowing from the discharge port 154 into the discharge manifold 130. The plurality of outlets 136 may be shaped, numbered, and arranged so as to place a sufficient back pressure on the discharge manifold 130 to provide relatively even outflow of the airflow 50 across the plurality of outlets 136. The airflow 50 entering the chamber 12 via the plurality of outlets 136 on the back wall 134 may be generally horizontal or lateral in direction. Thus, the general direction of the airflow 50 may be horizontal or lateral in the chamber 12 from the back wall 134 toward the front opening 13 (or door 14). In addition, the airflow 50 may generally flow vertically upward in the chamber 12 toward the plurality of inlets 142. Due to the back-to-front lateral direction of the airflow 50 previously described, a substantial portion of the airflow 50 may flow vertically upward in the chamber 12 at or proximate to the front opening 13 and outer door 14 (and inner doors 17 as shown in FIGS. 2 and 3).

After entering the suction manifold 140 via the plurality of inlets 142, the airflow 50 may change direction from vertical to horizontal or lateral and may progress through the suction manifold 140 to the suction port 152. The airflow 50 may then change direction again from lateral to vertical in the suction port 152, and may progress vertically through the suction port 152 into the enclosure 150. Upon entering the enclosure 150, the airflow 50 may once again change direction from vertical to lateral so as to progress through the enclosure 150 through, over, and/or across the evaporator 124. As the airflow 50 thermally engages with the evaporator 24, heat from the airflow 50 is transferred to the second refrigerant (FIG. 4) flowing through the evaporator 124 so that the temperature of the airflow 50 is reduced. Thereafter, the cooled airflow 50 is pulled into the blower 36 to restart the cycle described above.

Without being limited to this or any other theory, heat in the chamber 12 may tend to rise vertically via natural convection (that is, independent of the airflow 50). As a result, placing the evaporator 124 in the enclosure 150 vertically above the chamber 12 may take advantage of this natural migration of heat so as to more efficiently encourage relatively warmer air to flow toward the evaporator 124. More specifically, the vertically upward direction of airflow 50 within the chamber 12 may work in concert with natural convection so as to more efficiently sweep relatively warmer air out of the chamber 12 and toward the evaporator 124 via suction ducting 32. Accordingly, the general arrangement of the evaporator 124, chamber 12, and ducting 30 may more efficiently eliminate heat from the chamber 12 so that temperatures may be more efficiently and reliably lowered therein. In addition, again without being limited to this or any other theory, the multiple direction changes described above for the airflow 50 when the airflow 50 is progressing into the chamber 12 from the enclosure 150, from the chamber 12 to the enclosure 150, and through the enclosure 150 itself may be configured to restrict or minimize unintentional mixing of air in the chamber 12 and enclosure 150 when the blower 36 is not operating (e.g., such as during a defrost operation).

Referring now to FIGS. 5 and 7-10, the suction manifold 140 may be at least partially formed or defined by a tray 160 that is removably inserted into the chamber 12 at (or proximate to) the upper end 12*a*. Specifically, the tray 160 may have a planar base 162 and one or more side walls 164 extending normally away from the base 162. The tray 160 may be inserted into the chamber 12 so that the base 162 extends substantially laterally or horizontally, such that the one or more side walls 164 extends generally vertically upward from the base 162. In addition, when the tray 160 is inserted into the chamber 12, the base 162 and side wall(s) 164 of the tray 160 and the upper end 12*a* of the chamber 12 may define the suction manifold 140 in the chamber 12, and the inlets 142 may be positioned along the base 162.

Figure 8:
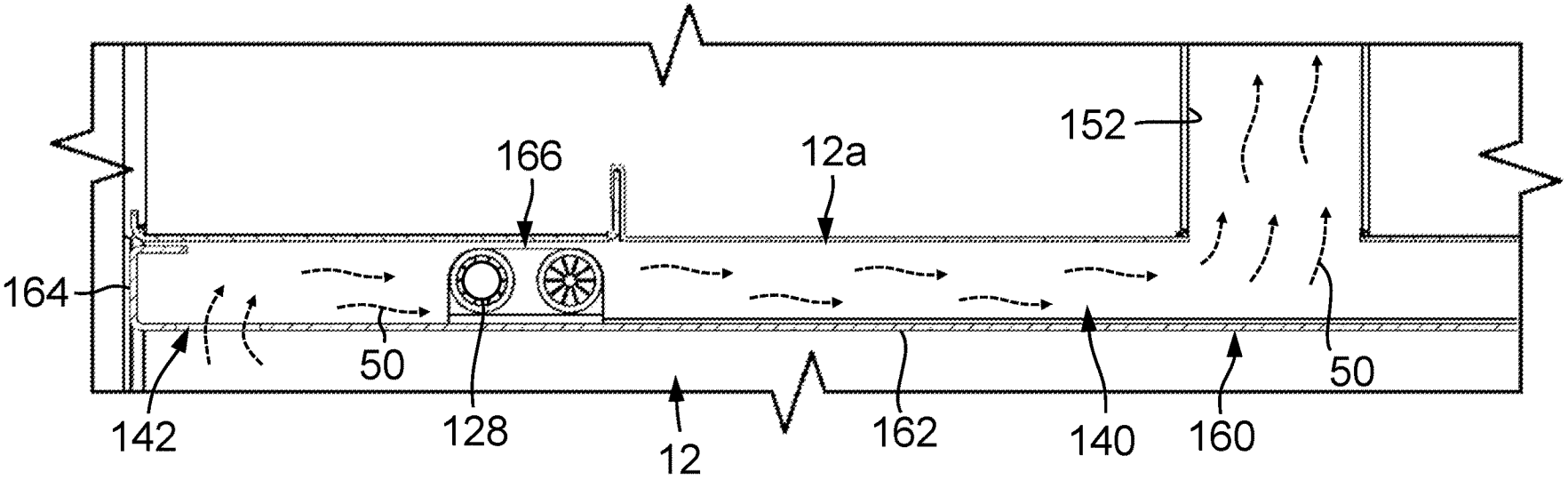
FIG. 8 is an enlarged, partial side cross-sectional view of a portion of suction duct of the cold storage system of FIG. 1 according to some embodiments disclosed herein.
Figure 9:
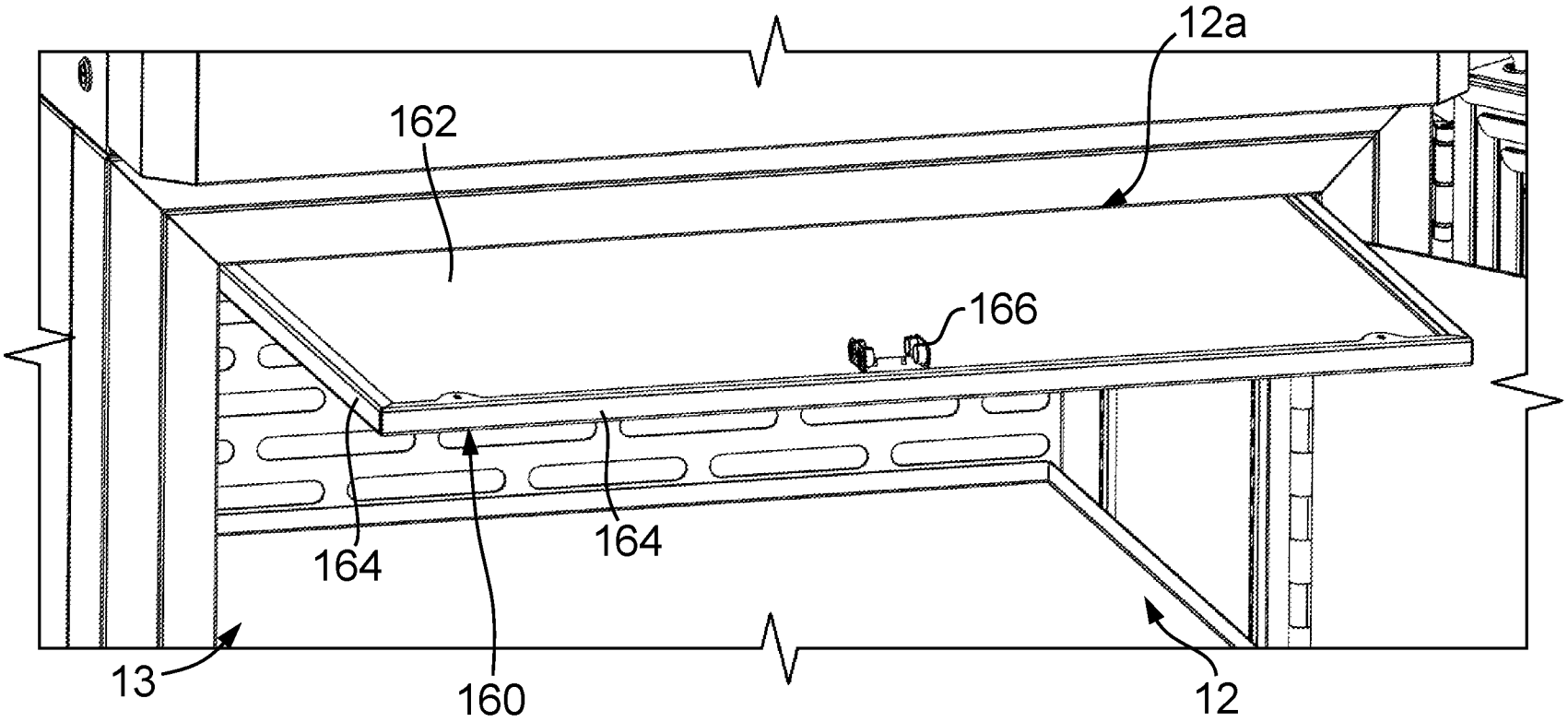
FIG. 9 is an enlarged perspective view of the inner storage chamber of the cold storage system of FIG. 1, illustrating a tray that at least partially defines the suction duct of FIG. 8 pulled out from the inner storage chamber according to some embodiments disclosed herein.
Figure 10:
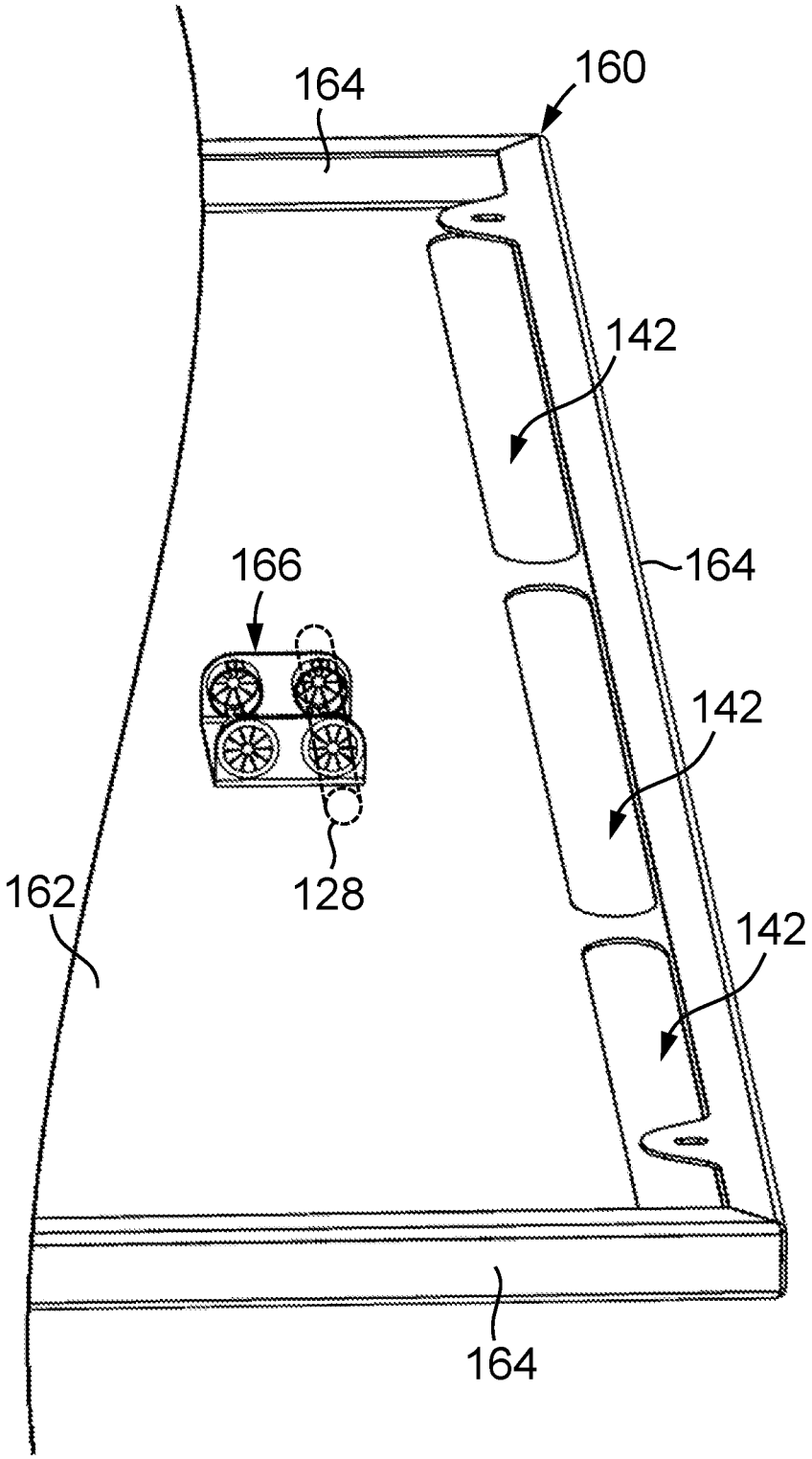
FIG. 10 is a perspective view of a portion of the tray of FIG. 9 according to some embodiments disclosed herein.

As shown in FIGS. 8-10, the temperature sensor 128 may be secured to the tray 160 via a bracket 166. Specifically, the bracket 166 is mounted to the base 162 within the suction manifold 140 so that the airflow 50 is flowed over and/or around the temperature sensor 128 within the suction manifold 140, after flowing into the plurality of inlets 142. As previously described, the airflow 50 may be at a highest average temperature within the suction manifold 140 after flowing through the chamber 12 (and engaging with the products stored therein). As a result, placing the temperature sensor 128 in the suction manifold 140 via being mounted to the tray 160 via bracket 166, the temperature sensor 128 may provide a "worst-case" measurement for the temperature of the airflow 50 so that the controller 40 (FIG. 4) may control operation of the refrigeration module 100 more conservatively to ensure a desired temperature in the chamber 12 during operations.

In addition, mounting the temperature sensor 128 to the base 162 of the tray 160 may simplify the process for inspection, calibration, maintenance, installation, or removal (collectively referred to as "maintenance activities") of the temperature sensor 128. Specifically, as best shown in FIGS. 9 and 10, the tray 160 may be slid out from the front opening 13 of chamber 12 so as to expose at least a portion of the base 162. Because the bracket 166 and temperature sensor 128 is placed proximate the plurality of inlets 142 along the base 162, even partial withdrawal of the tray 160 from the front opening 13 of chamber 12 as shown in FIG. 9 may fully expose the bracket 166 and temperature sensor 128 outside of the chamber 12 for maintenance activities, such as removing frost from the duct.

Figure 11:
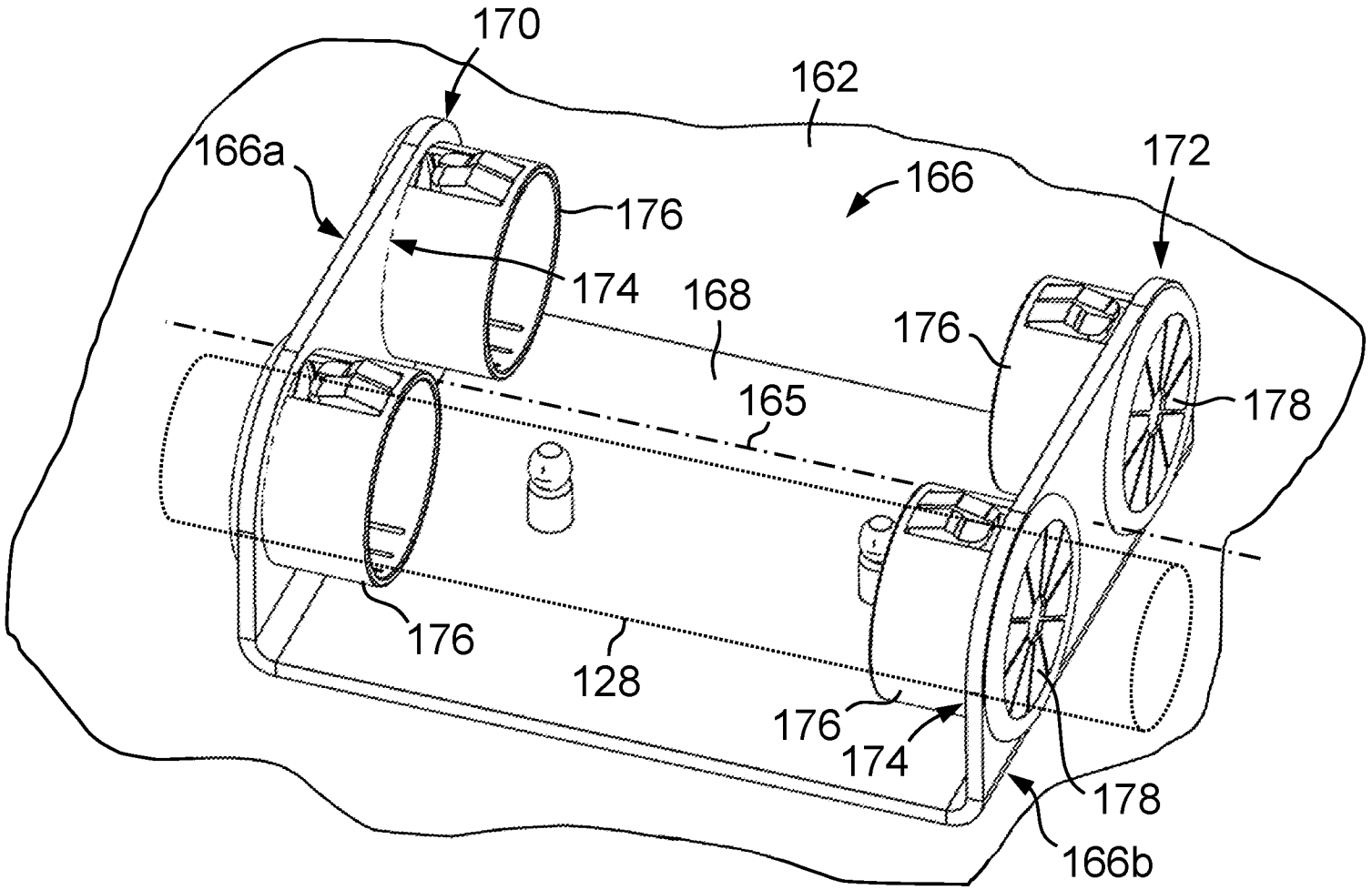
FIG. 11 is a perspective view of a bracket for holding a temperature sensor on the tray of FIG. 9 according to some embodiments disclosed herein.

Referring now to FIG. 11, in some embodiments, the bracket 166 may include a longitudinal axis 165 (or more simply "axis" 165), a first end 166*a*, and a second end 166*b* opposite the first end 166*a* such that the ends 166*a*, 166*b* are spaced from one another along the axis 165. In addition, the bracket 166 includes planar, base plate 168 that extends axially between the ends 166*a*, 166*b* relative to axis 165. The base plate 168 may comprise a rectangular plate that is elongated along the axis 165.

A pair of mounting ears 170, 172 extend normally outward from the base plate 168 in a radial direction relative to axis 165. Specifically, a first mounting ear 170 may be placed at the end first end 166*a*, and a second mounting ear 172 may be placed at the second end 166*b*. Thus, the mounting ears 170, 172 may be axially spaced along the axis 165. In some embodiments, the mounting ears 170, 172 may be formed by folding or bending portions of the base plate 168 vertically upward. Thus, in some embodiments, the mounting ears 170, 172 may be integrally formed with the base plate 168 so as to define a single-piece, monolithic body therewith. The base plate 168 may be secured to the base 162 of tray 160 (FIGS. 7-9) so that the pair of mounting ears 170, 172 extend normally away (and vertically upward from) the base 162 of bracket 166 to thereby more centrally place the sensor 128 within the suction manifold 140 during operations.

Each mounting ear 170, 172 may include one or more connection apertures 174 extending therethrough. The one or more connection apertures 174 in each mounting ear 170, 172 may be aligned (e.g., in an axial direction relative to axis 165) with a corresponding one of the one or more connection apertures 174 extending through the other mounting ear 170, 172. The embodiment of bracket 166 shown in FIG. 11 may be configured to hold two sensors (e.g., temperature sensor 128 and/or another sensor for measuring temperature or another parameter, such as a temporary sensor for calibration purposes). Thus, each mounting ear 170 includes a pair of connection apertures 174 extending therethrough.

A grommet 176 may be inserted through each of the connection apertures 174 so as to engage with and support a portion of a corresponding sensor during operations. Specifically, in some embodiments, each grommet 176 may include a plurality of support fingers 178 extending in a generally radially oriented plane relative to axis 165 that may engage with and suspend a body of a sensor (e.g., temperature sensor 128) in the corresponding connection aperture 174.

Figure 12:
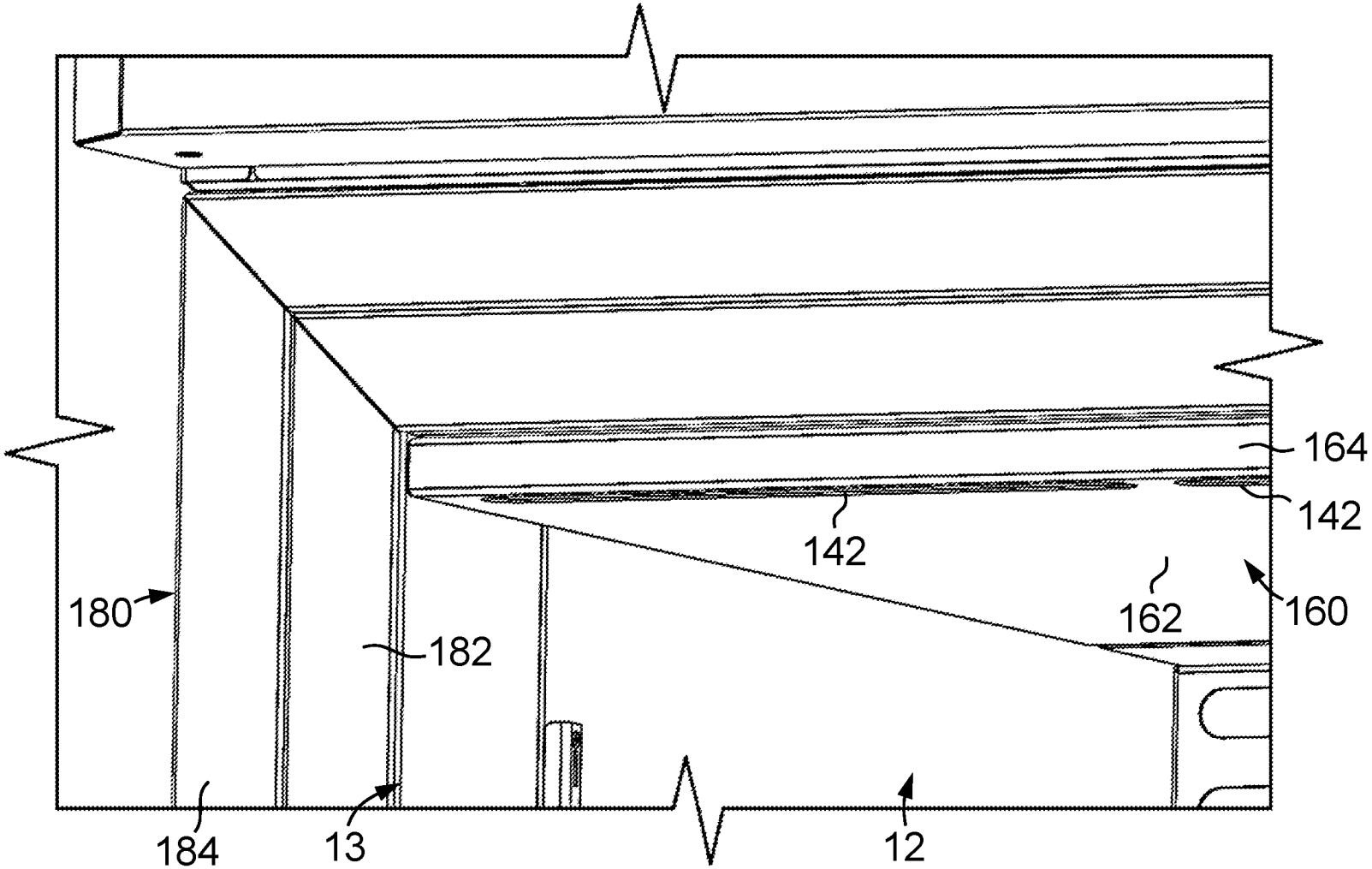
FIG. 12 is an enlarged perspective view of a portion of a door jamb of the cold storage system of FIG. 1 according to some embodiments disclosed herein.
Figure 13:
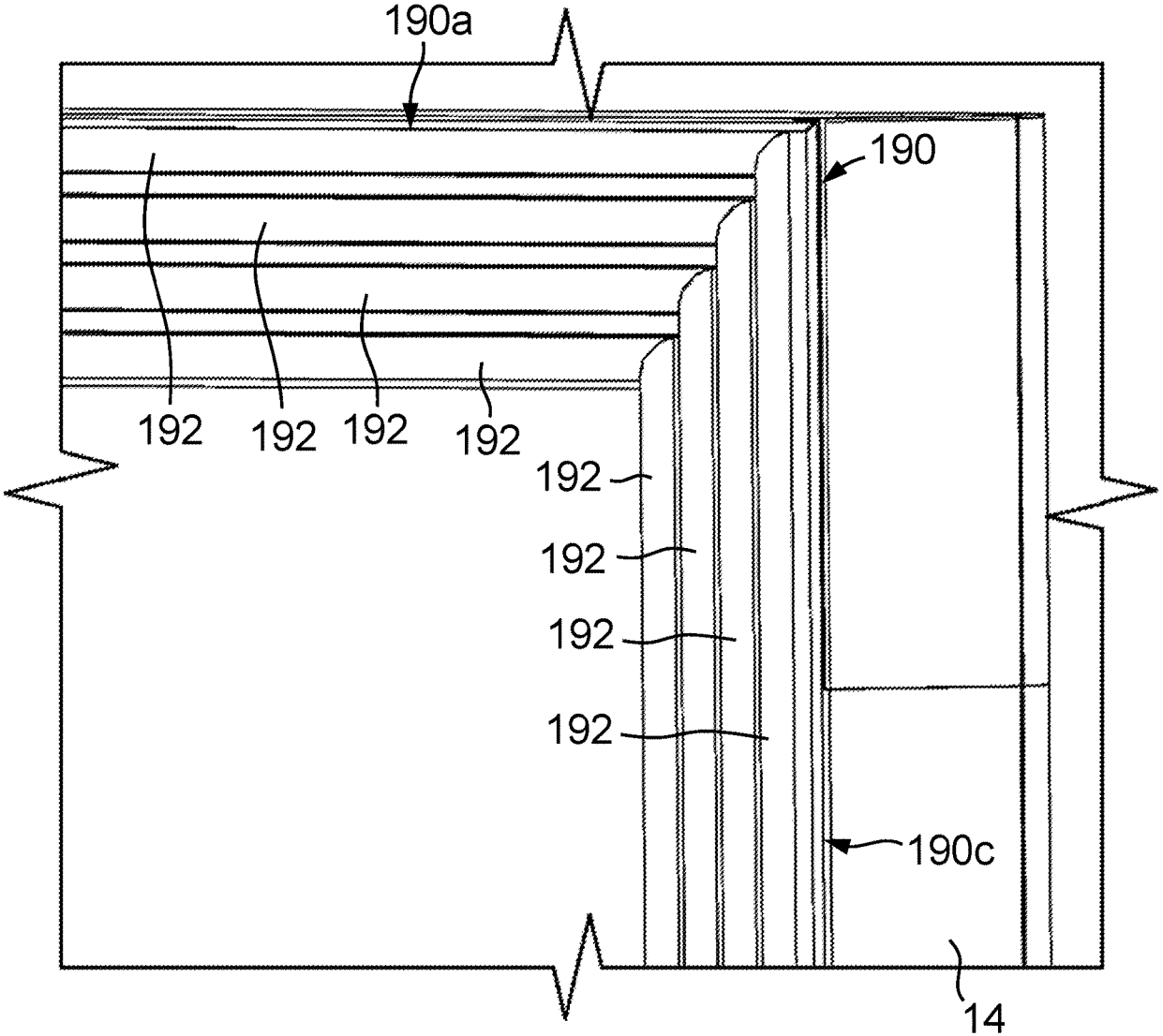
FIG. 13 is an enlarged perspective view of a portion of a door seal on the outer door of the cold storage system of FIG. 1 according to some embodiments disclosed herein.

Referring to FIGS. 3, 12, and 13, the housing 15 may include a door jamb 180 that at least partially surrounds the front opening 13 into chamber 12, and the outer door 14 may include a door seal 190 that is configured to engage with the door jamb 180 in order to seal off the chamber 12 from the ambient environment 5 when the outer door 14 is closed (FIG. 1). The door jamb 180 may include a pair of door stops—namely a first door stop 182 and a second door stop 184. The door stops 182, 184 may be more simply referred to herein as "stops" 182, 184. In addition, the door seal 190 includes a plurality of sealing projections 192 that are configured to sealingly engage with the first stop 182 and second stop 184 of door jamb 180 to seal off or isolate the chamber 12 from the ambient environment 5.

As previously described, the door jamb 180 (which may be referred to herein as a "mullion") may include the first stop 182 and the second stop 184. The stops 182, 184, may extend adjacent and parallel to one another along each of the edges of the front opening 13. The stops 182, 184 may also be discontinuous from one another so as to allow for independent thermal expansion during operations as explained in more detail below. The first stop 182 may be referred to herein as the "inner" stop given that the first stop 182 is positioned immediately adjacent the front opening 13. In addition, the second stop 184 may be referred to herein as the "outer" stop given that the second stop 184 is positioned outside of the first stop 182 relative to the front opening 13. Thus, the inner stop 182 is positioned between the front opening 13 and the outer stop 184, and the outer stop 184 may be positioned around the first stop 182.

Referring specifically to FIG. 3, the front opening 13 may be quadrilateral in shape (e.g., such as rectangular). Thus, the door jamb 180 and particularly the stops 182, 184 may also have a corresponding rectangular shape to conform with the rectangular shape of the front opening 13. Specifically, the stops 182, 184 of the door jamb 180 may comprise separate, elongate linear segments so as to conform to the rectangular shape of front opening 13. The stops 182, 184 may each have an upper segment 182*a*, 184*a*, a lower segment 182*b*, 184*b*, and a pair of vertically oriented side segments 182*c*, 184*c*, respectively. The side segments 182*c*, 184*c* may extend vertically between the upper segments 182*a*, 184*a* and lower segments 182*b*, 184*b*, respectively. The upper segments 182*a*, 182*b* may extend substantially parallel to one another, the lower segments 182*b*, 184*b* may extend substantially parallel to one another, and the side segments 182*c*, 184*c* may all extend substantially parallel to one another.

Figure 14:
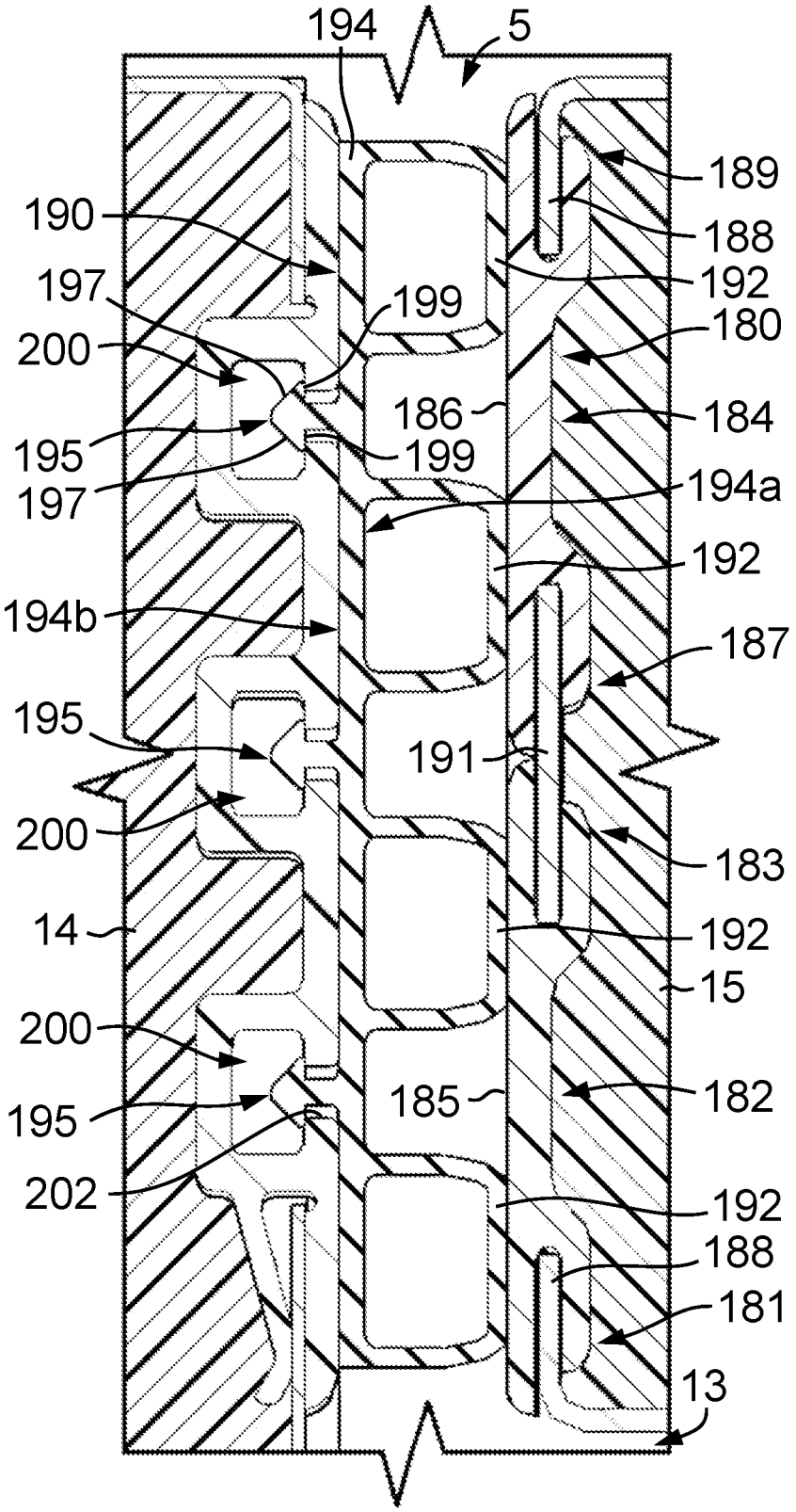
FIG. 14 is a side cross-sectional view of the door jamb of FIG. 12 and the door seal of FIG. 13 engaged with one another to seal off the inner storage chamber of the cold storage system of FIG. 1 according to some embodiments disclosed herein.

Referring now to FIG. 14, along each of the segments 182*a*, 184*a* and 182*b*, 184*b* and 182*c*, 184*c* the stops 182, 184 may be independent members that are separate, distinct, and discontinuous from one another. As a result, each of the stops 182, 184 may be configured to thermally expand or contract independently from one another. As will be described in more detail below, the independent expansion/contraction of the stops 182, 184 may prevent or at least reduce the risk of deformation (e.g., buckling) of the door jamb 180 which may lead to a loss of sealing engagement with door seal 190 during operations.

Each segment 182*a*, 182*b*, 182*c*, 182*d* of inner stop 182 may include a first or inner side 181 and a second or outer side 183—with the inner side 181 being more proximate to the front opening 13 than the outer side 183. A seal surface 185 extends between the sides 181, 183. The seal surface 185 may comprise a substantially planar surface that is configured to engage with one or more of the sealing projections 192 of door seal 190 during operations. Similarly, each segment 184*a*, 184*b*, 184*c*, 184*d* of outer stop 182 may include a first or inner side 187 and a second or outer side 189—with the inner side 187 being more proximate to the front opening 13 than the outer side 189. A seal surface 186 extends between the sides 187, 189. The seal surface 186 may comprise a substantially planar surface that is configured to engage with one or more of the sealing projections 192 of door seal 190 during operations.

An elongate connecting member 191 may be inserted between the inner stop 182 and outer stop 184 (along each segment 182*a*, 182*b*, 182*c* and 184*a*, 184*b*, 184*c*, respectively). Specifically, the outer side 183 of inner stop 182 and the inner side 187 of outer stop 184 may be connected to the elongate connecting member 191 via tongue-and-groove joints. Specifically, the outer side 183 of inner stop 182 and the inner side 187 of outer stop 184 may each form grooves and the connecting member 191—being formed as an elongate plate—may form suitable tongues that are inserted into the grooves formed on the sides 183, 187 of stops 182, 184, respectively. However, it should be appreciated that the connections may be alternatively configured—such as by forming grooves on the ends of the connecting member 191 that receive "tongues" formed on the ends 183, 187 of stop 182, 184 in some embodiments.

In addition, similar tongue-and-groove joints may be formed between the stops 182, 184 and the structure of housing 15 about front opening 13. Specifically, the inner side 181 of inner stop 182, and outer side 189 of outer stop 184 may form grooves that receive tongues 188 formed on the housing 15. As with the connection between connecting member 191 and sides 183, 187 of stops 182, 184, respectively, the connections between sides 181, 189 of stops 182, 184, respectively and housing 15 may be alternatively configured. For instance, the housing 15 may form "grooves" that receive "tongues" formed on the ends 181, 189 of stops 182, 184.

The connection between the stops 182, 184, connecting member 191, and housing 15 (e.g., via tongues 188) may allow the stops 182, 184 to slide, contract, or expand in the lengthwise direction (e.g., into and out of the page in the view shown in FIG. 14) relative to the connecting member 191 and housing 15 and relative to one another during operations. Thus, each segment 182*a*, 182*b*, 182*c* of inner door stop 182 may expand or contract (e.g., along their length) relative to the corresponding segments 184*a*, 184*b*, 184*c* of outer door stop 184 during operations.

Various materials may be utilized to form the stops 182, 184 and connecting member 191 along each of the segments 182*a*, 184*a* and 182*b*, 184*b* and 182*c*, 184*c*. For instance, the inner stop 182, outer stop 184, and connecting members 191 may comprise suitable polymers such as fiber-reinforced plastics (FRP), thermoplastics, ultra-high molecular weight (UHMW) polyethylene, or some combination thereof. However, other materials and material combinations are contemplated herein. In some embodiments, the stops 182, 184 may be formed from different materials or different material combinations.

In some embodiments, the materials chosen for the stops 182, 184 may be selected based on their thermal contraction or expansion properties. For instance, the materials 182, 184 may be formed of materials that are selected to ensure that the seal surfaces 185, 186 are substantially flat when they are placed under the expected temperature gradients associated with operation of the freezer 10 with the outer door 14 closed (FIGS. 1-3).

Figure 15:
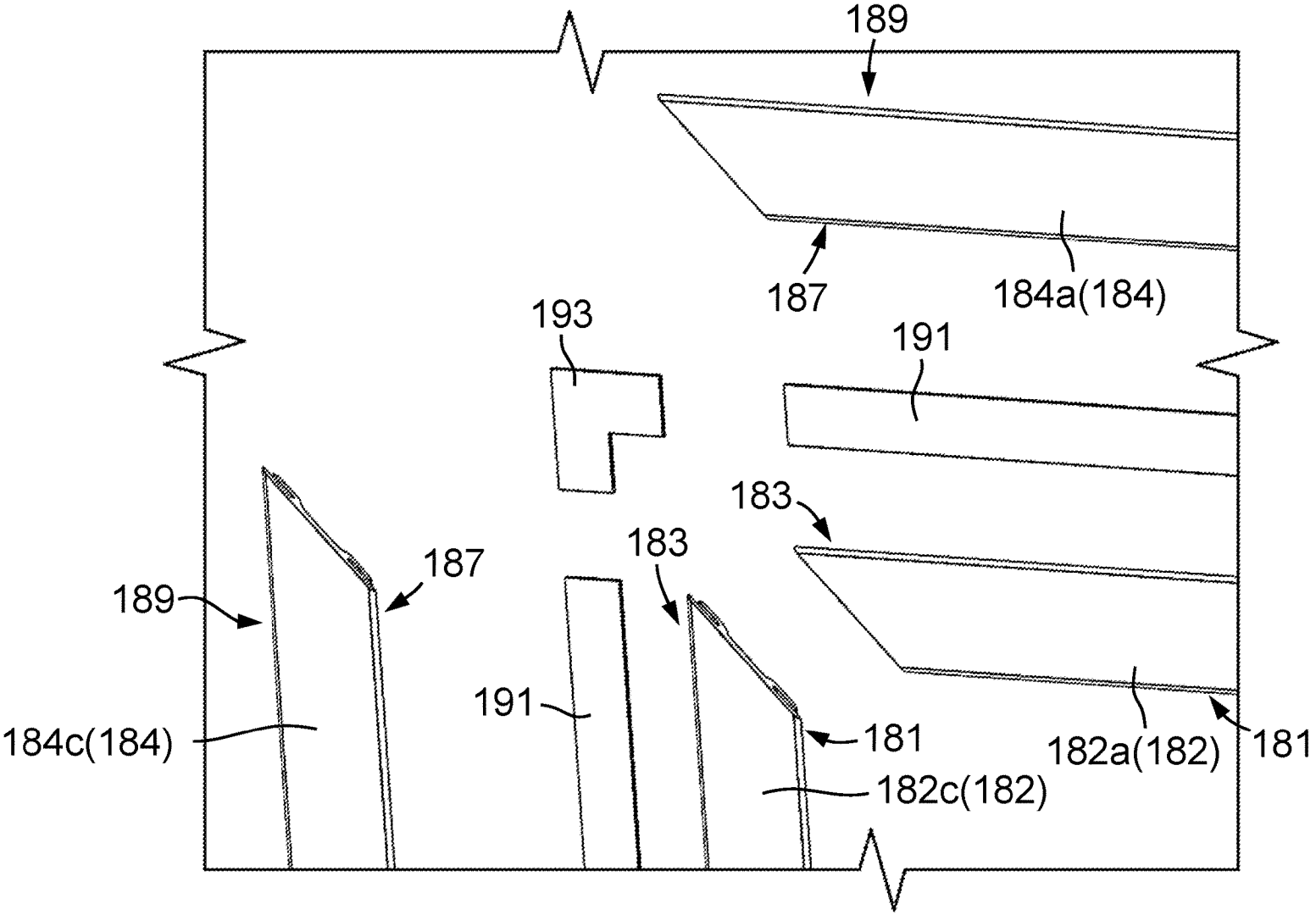
FIG. 15 is an exploded view of a portion of the door jamb of FIG. 12 according to some embodiments disclosed herein.

Referring now to FIG. 15, L-shaped corner members 193 may be connected between the door stops 182, 184 at the intersections of the segments 182*a*, 182*b*, 182*c*, 184*a*, 184*b*, 184*c*. Specifically, FIG. 15 shows a partial exploded view of the door stop 180 at one of the intersections of the upper segments 182*a*, 184*a* and side segments 182*c*, 184*c* of door stops 182, 184, respectively. As illustrated in FIG. 15, an L-shaped corner member 193 spans between the elongate connecting members 191 that extend along the segments 182*a*, 184*a* to complete the corner. In addition, the L-shaped corner member 193 may form tongues that are received within the grooves formed at the sides 183, 187 at the intersection. The segments 182*a*, 184*a*, 182*c*, 184*c* may have angled or mitered cuts so as to form at a 90° angle at the corner/intersection thereof. Without being limited to this or any other theory, the L-shape of the corner members 193 may help to prevent separation of the segments 182*a*, 184*a*, 182*c*, 184*c* at the mitered corners as a result of temperature change of the segments 182*a*, 184*a*, 182*c*, 184*c* over time. It should be appreciated that similar L-shaped corner members 193 may be used to connect the segments 182*a*, 184*a* and the segments 182*b*, 184*b* to the side segments 182*c*, 184*c* at the other corners of the door stop 180 in a similar fashion to that shown in FIG. 15.

As previously described, the freezer 10 (FIGS. 1-3) may be configured to achieve and/or maintain (e.g., via the refrigeration module 100) ultra-low temperatures (e.g., −50° C. or below) in the chamber 12 despite the typical indoor conditions of the ambient environment 5. Thus, when the outer door 14 is closed, the inner side 181 of inner stop 182 may be exposed to ultra-low temperatures while the outer side 189 of outer stop 184 may be exposed to the ambient environment 5. As a result of this extreme temperature difference (e.g., of about 100° C. in some cases), the inner stop 182 may experience a significant thermal contraction relative to the outer stop 184. However, the connection between the stops 182, 184, connecting member 191, and housing 15 is configured to allow the inner stop 182 (particularly the segments 182*a*, 182*b*, 182*c*) to thermally contract (e.g., in the lengthwise direction) without imparting compressive or other strain to the outer stop 184 (particularly segments 184*a*, 184*b*, 184*c*). As a result, the thermal contraction of the inner stop 182 may not cause a deformation of the seal surface 186 of the outer stop 184 so that the sealing engagement between the seal surface 186 and the corresponding seal projections 192 of door seal 190 may be maintained.

Referring again to FIGS. 3 and 13, door seal 190 may have a generally rectangular shape to correspond with the rectangular shape of the stops 182, 184 of door jamb 180. Specifically, the door seal 190 may have an upper segment 190*a*, a lower segment 190*b*, and a pair of vertically oriented side segments 190*c*. The side segments 190*c* may extend vertically between the upper segment 190*a* and the lower segment 190*b*. The plurality of sealing projections 192 may extend along each of the segments 190*a*, 190*b*, 190*c*.

Referring again to FIG. 14, along each segment 190*a*, 190*b*, 190*c*, the sealing projections 192 may engage with the seal surfaces 185, 186 of the stops 182, 184, respectively, of door jamb 180, so as to seal off the chamber 12 from the ambient environment 5 when outer door 14 is closed. Specifically, each segment 190*a*, 190*b*, 190*c* may include a common base 194, and the plurality of sealing members 192 may be formed on and project outward from a first side 194*a* of the base 194. A plurality of connectors 195 are formed on and project outward from a second side 194*b* of the base 194 that is opposite the first side 194*a*.

As may be appreciated from FIGS. 13 and 14, each of the sealing projections 192 may have an arcuate convex shape (e.g., when not in contact with the seal surfaces 185, 186 of stops 182, 184, respectively) (sometime referred to as bulb seals); however other shapes and curvatures are contemplated (e.g., rectangular cross-sections, triangular cross-sections, flaps, etc.). The plurality of sealing projections 192 may be hollow or semi-hollow so that they may be at least partially deformed or flattened when in contact with the corresponding seal surface 185, 186, so as to facilitate sealing contact therewith.

Each of the plurality of sealing projections 192 may form a separate seal with the door jamb so as to create redundancy in the sealing contact between the door seal 190 and door jamb 180. Specifically, a first portion of the sealing projections 192 may engage with the seal surface 185 of the inner stop 182, while a second, remaining portion of the sealing projections 192 may engage with the seal surface 186 of the outer stop 184 about the door jamb 180. In the embodiment illustrated in FIG. 14, the door seal 190 includes a total of four (4) sealing projections 192 on each segment 190*a*, 190*b*, 190*c*, with two (2) of the sealing projections 192 being configured to engage with the seal surface 185 of the inner stop 182, and a remaining two (2) of the sealing projections 192 being configured to engage with the seal surface 186 of the outer stop 184. Thus, the sealing engagement between the door seal 190 and the inner stop 182 may be independent of the sealing engagement between the door seal 190 and the outer stop 184 via the separate sealing projections 192.

Referring still to FIG. 14, the connectors 195 may include an arrowhead-shaped cross-section that includes a pair of angled surfaces 197 that diverge outward from one another to define a pair of shoulders 199. The connectors 195 may extend along the length of the base 194 for each of the segments 190*a*, 190*b*, 190*c*. The outer door 14 may include a plurality of cavities 200 that each have a corresponding opening 202 formed therein. The inner diameter of the openings 202 may be narrower than an inner width or diameter of the corresponding cavities 200. The cavities 200 may receive the connectors 195 therein via the openings 202 so as to secure the door seal 190 to the inner side of the outer door 14 as shown. Specifically, the narrow openings 202 may be sized so that when the connectors 195 are inserted therethrough, the angled surfaces 197 of each connector 195 are deflected and deformed inward until the shoulders 199 are advanced into the cavity 200 and past the opening 202, at which point the angled surfaces 197 may diverge outward to their normal condition so that the shoulders 199 may prevent or at least restrict withdrawal of the connector 195 from the cavity 200 via the narrow opening 202.

The base 194, sealing projections 192, and connectors 195 of each segment 190*a*, 190*b*, 190*c* may each be formed as a single-piece, monolithic body. In some embodiments, each segment 190*a*, 190*b*, 190*c* of the door seal 190 may be formed from a resilient material, such as an elastomeric material (e.g., natural or synthetic rubber). Thus, the segments 190*a*, 190*b*, 190*c* of the door seal 190 may be compliant so as to facilitate sealing engagement between the sealing projections 192 and the seal surfaces 185, 186 of stops 182, 184, and insertion of connectors 195 through openings 202 of cavities 200 as described herein.

Referring briefly again to FIG. 5, in some embodiments, a similar jamb and seal assembly 19 may be arranged between the upper portion 18 and lower portion 16 of housing 15 in order to seal the enclosure 150 from the ambient environment 5. Thus, the jamb and seal assembly 19 arranged between the portions 18, 16 of housing 15 for sealing off the enclosure 150 may be configured the same or similar to the door seal 190 and jamb 180 as illustrated in FIG. 14 and described herein.

Referring again to FIGS. 5 and 6, a plurality of shelves 210 may be positioned in the chamber 12 of the freezer 10 (FIGS. 1-3) to support products (e.g., life-science products and materials) therein. As best shown in FIG. 5, the shelves 210 may be supported in the chamber 12 so that an outer perimeter of the shelves 210 are spaced from the inner walls of the chamber 12 to thereby allow airflow 50 to flow vertically upward in the chamber 12, around the shelves 210. As will be described in more detail herein, the shelves 210 may be supported in the chamber 12 via corresponding shelf support assemblies 250 so as to ensure adequate spacing for airflow 50.

Figure 16:
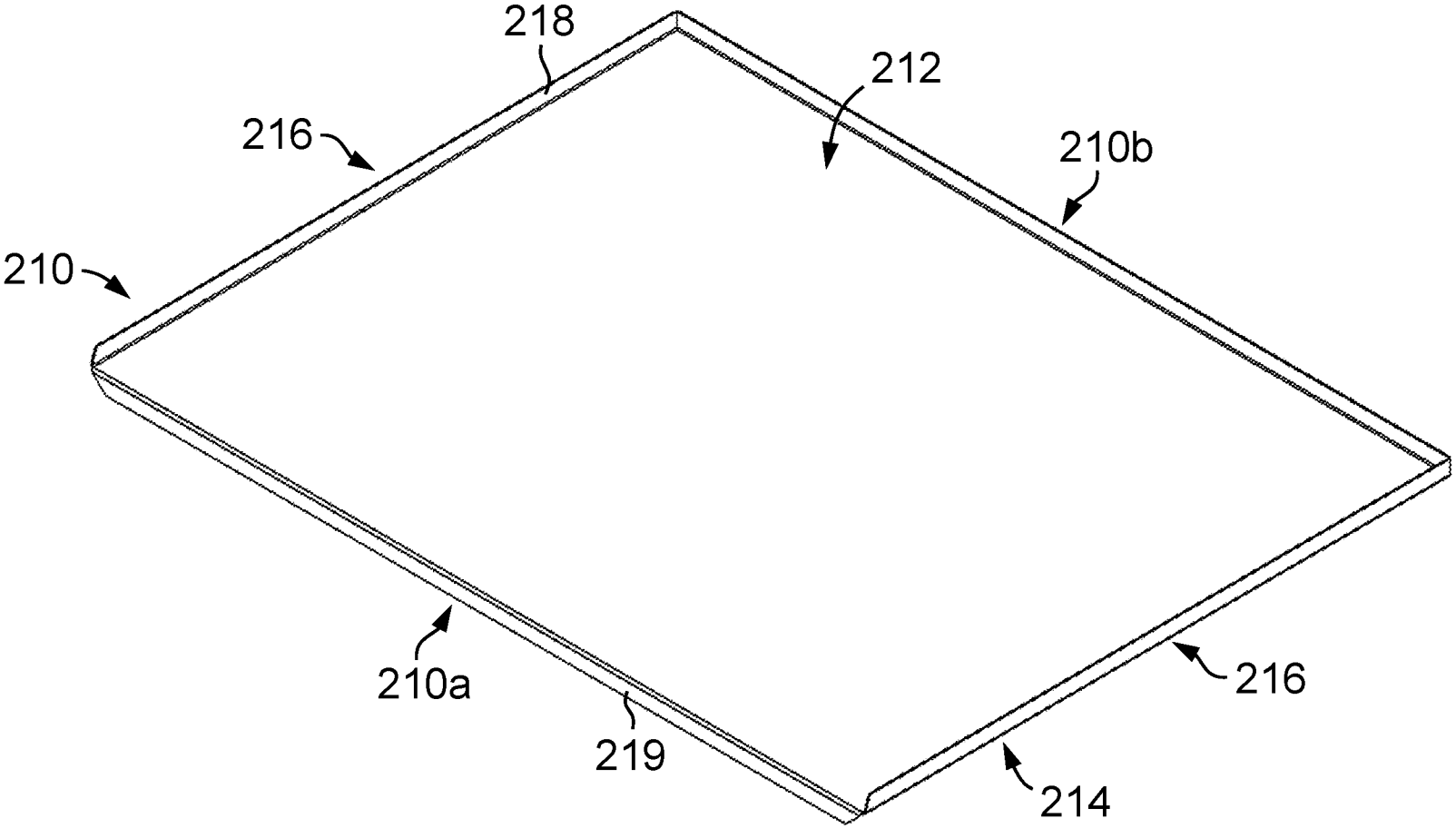
FIG. 16 is a top perspective view of a shelf that may be placed in the inner storage chamber of the cold storage chamber of FIG. 1 according to some embodiments disclosed herein.
Figure 17:
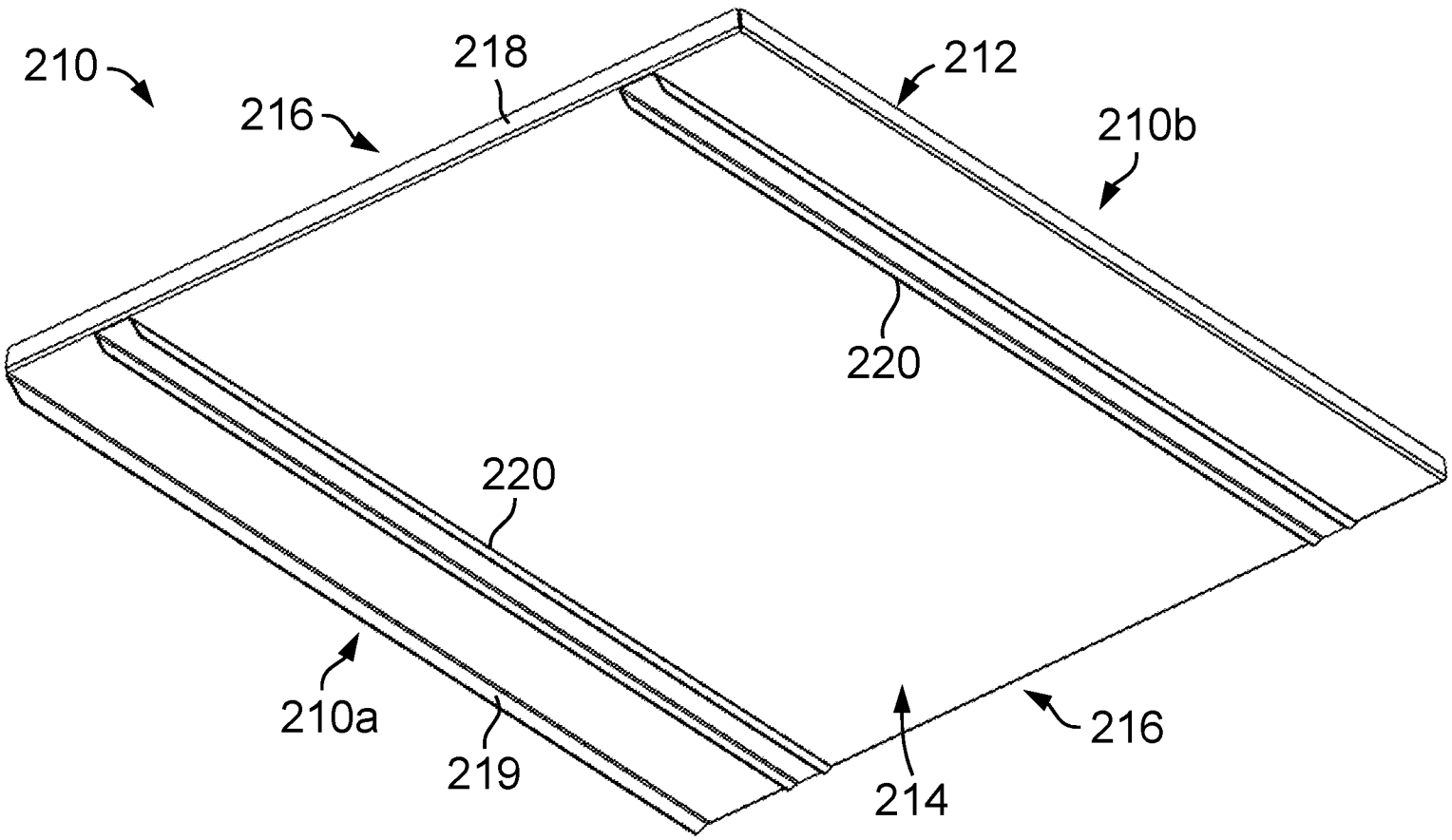
FIG. 17 is a bottom perspective view of the shelf of FIG. 16 according to some embodiments disclosed herein.

Referring now to FIGS. 16 and 17, each shelf 210 is a generally rectangular shaped member that has a top side 212 and a bottom side 214. In addition, the shelf 210 includes a front end 210*a*, and back 210*b*, and a pair of sides 216 extending between the ends 210*a*, 210*b*. Together, the front end 210*a*, back end 210*b*, and the pair of sides 216 define an outer perimeter of the shelf 210.

A retaining wall 218 extends upward (e.g., normally upward) from the top side 212 along the pair of sides 216 and the back end 210*b*. The retaining wall 218 may be configured to prevent products from overhanging the sides 216 and back end 210*b* (which may partially block the vertical flow of airflow 50 as shown in FIG. 3 during operations). In addition, a handle 219 may be formed on the front end 210*a* that extends downward (e.g., normally downward) from the bottom side 214. The handle 219 may be grasped by a user to facilitate insertion and removal of shelf 210 from the chamber 12.

The retaining wall 218 and handle 219 may be formed as a single-piece monolithic body with the main body of the shelf 210 in some embodiments. For instance, a single piece of sheet metal may be used to construct the main portion or body of the shelf 210. Three adjacent edges of the sheet metal may be bent upward along the top side 212 to form the retaining wall 218 and the remaining edge of the sheet metal may be bent downward along the bottom side 214 to form the handle 219.

As shown in FIG. 17, a pair of centering struts 220 are secured to the bottom side 214 of the shelf 210. The struts 220 may extend linearly between the sides 216 and are spaced from one another between the front end 210*a* and the back end 210*b*.

Referring again to FIG. 6, each of the shelves 210 may be supported in the chamber 12 with a shelf support assembly 250. In particular, the shelf support assembly 250 may include one or more vertically oriented support tracks 252 (or more simply "tracks" 252) mounted to the side walls 135 in the chamber 12. Each side wall 135 may include a pair of tracks 252 extending parallel to one another and spaced apart in the horizontal direction between the back wall 134 and front opening 13.

Figure 18:
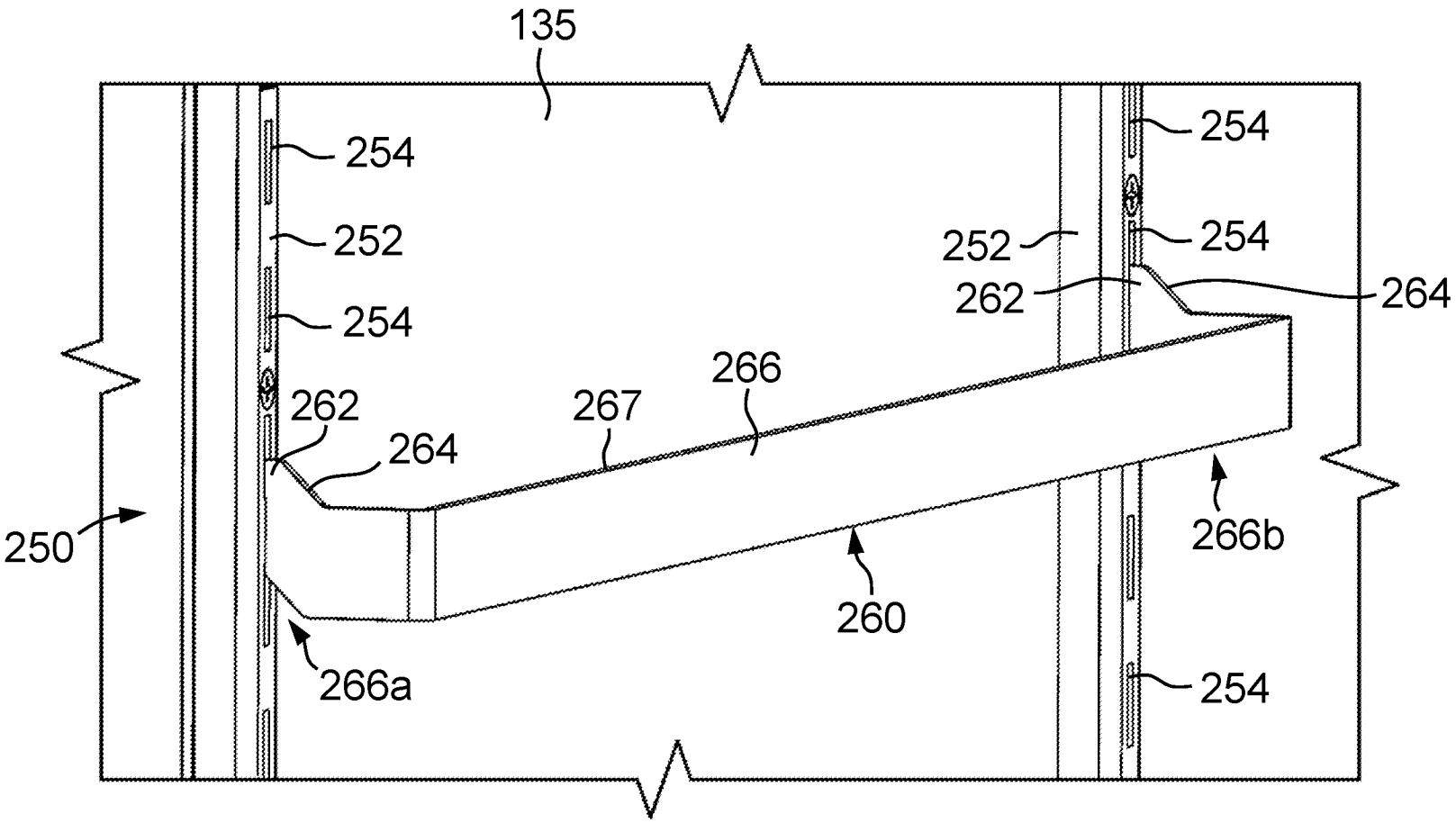
FIG. 18 is an enlarged perspective view of a shelf support assembly in the inner storage chamber of the cold storage system of FIG. 1 according to some embodiments disclosed herein.
Figure 19:
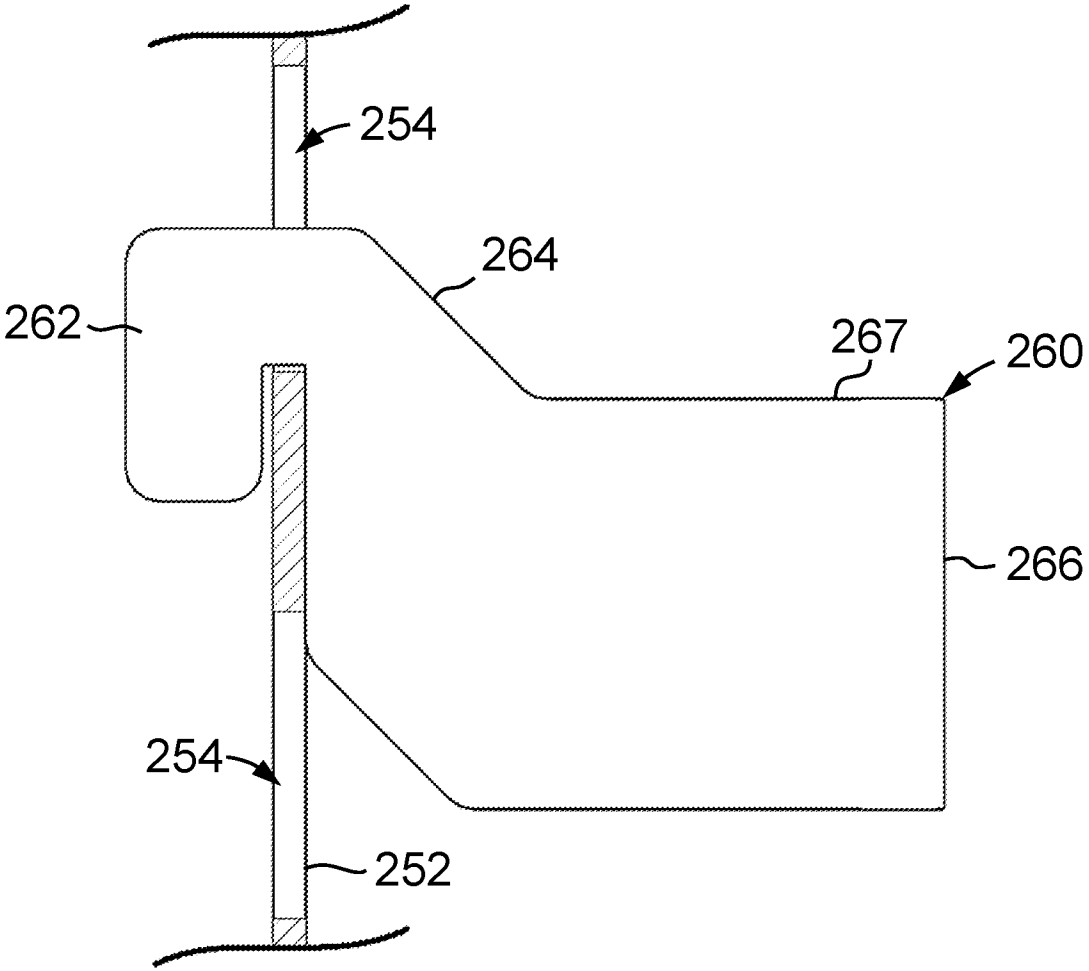
FIG. 19 is an enlarged cross-sectional view showing an engagement between a bracket and a support track of the shelf support assembly of FIG. 18 according to some embodiments disclosed herein.
Figure 20:
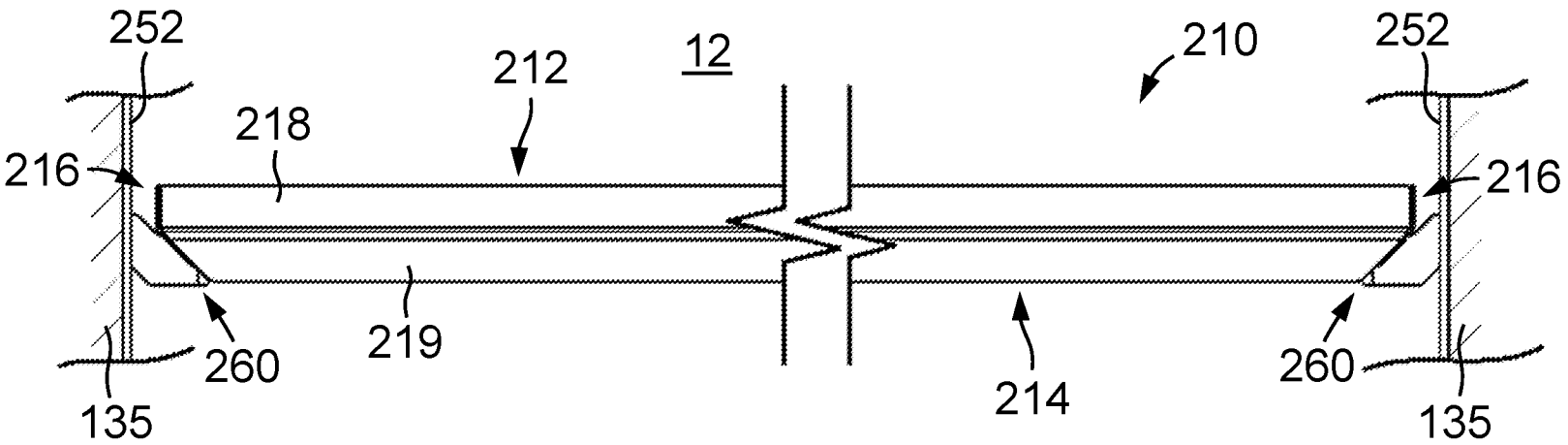
FIG. 20 is a front view of one of the shelves supported on the shelf support assembly of FIG. 18 according to some embodiments disclosed herein.

Referring now to FIGS. 18 and 19, the shelf support assembly 250 may also include one or more support brackets 260 (FIG. 18) (or more simply "bracket" 260) mounted on the support tracks 252 to, in turn, support a shelf 210 in the chamber 12. Each shelf 210 may be supported on two brackets 260 along the pair of sides 216 (FIG. 20). In addition, each bracket 260 may be engaged to the pair of tracks 252 along a corresponding one of the side walls 135 in the chamber 12 so that the bracket 260 spans horizontally between the pair of tracks 252.

Each bracket 260 includes a U-shaped saddle 266 having a first end 266*a*, a second end 266*b* opposite the first end 266*a*, and an upper planar support surface 267 extending between (e.g., horizontally between) the ends 266*a*, 266*b*. A hook assembly 262 is connected to each end 266*a*, 266*b* that is configured to engage with one of the tracks 252. Specifically, each track 252 includes a plurality of vertically spaced slots (or apertures) 254. The hook assemblies 262 of support bracket 260 may be inserted into corresponding slots 254 in the tracks 252 to thereby suspend the bracket 260 from the tracks 252 (e.g., as shown in FIG. 18).

Each hook assembly 262 may have a ramped surface 264 that is adjacent to the upper planar support surface 267. Specifically, the ramped surfaces 264 may angle downward toward the support surface 267. As shown in FIGS. 18 and 19, the ramped surfaces 264 may be planar surfaces; however, the ramped surfaces 264 may have some non-linear curvature in some embodiments.

Referring now to FIG. 20, each shelf 210 may be supported on a pair of brackets 260 that are each, in turn supported on the pair of tracks 252 on a corresponding one of the side walls 135 in chamber 12 as previously described. The engagement between the shelf 210 and the pair of brackets 260 may laterally center (or substantially center) the shelf 210 in the chamber 12 so that the outer perimeter of the shelf 210 (including ends 210*a*, 210*b*, sides 216) is spaced from the inner walls of the chamber 12 (including the back wall 134, side walls 135, and front opening 13 (or inner surfaces of the inner doors 17) so as to allow airflow 50 to flow vertically upward in the chamber 12 as previously described (FIG. 5).

Figure 21:
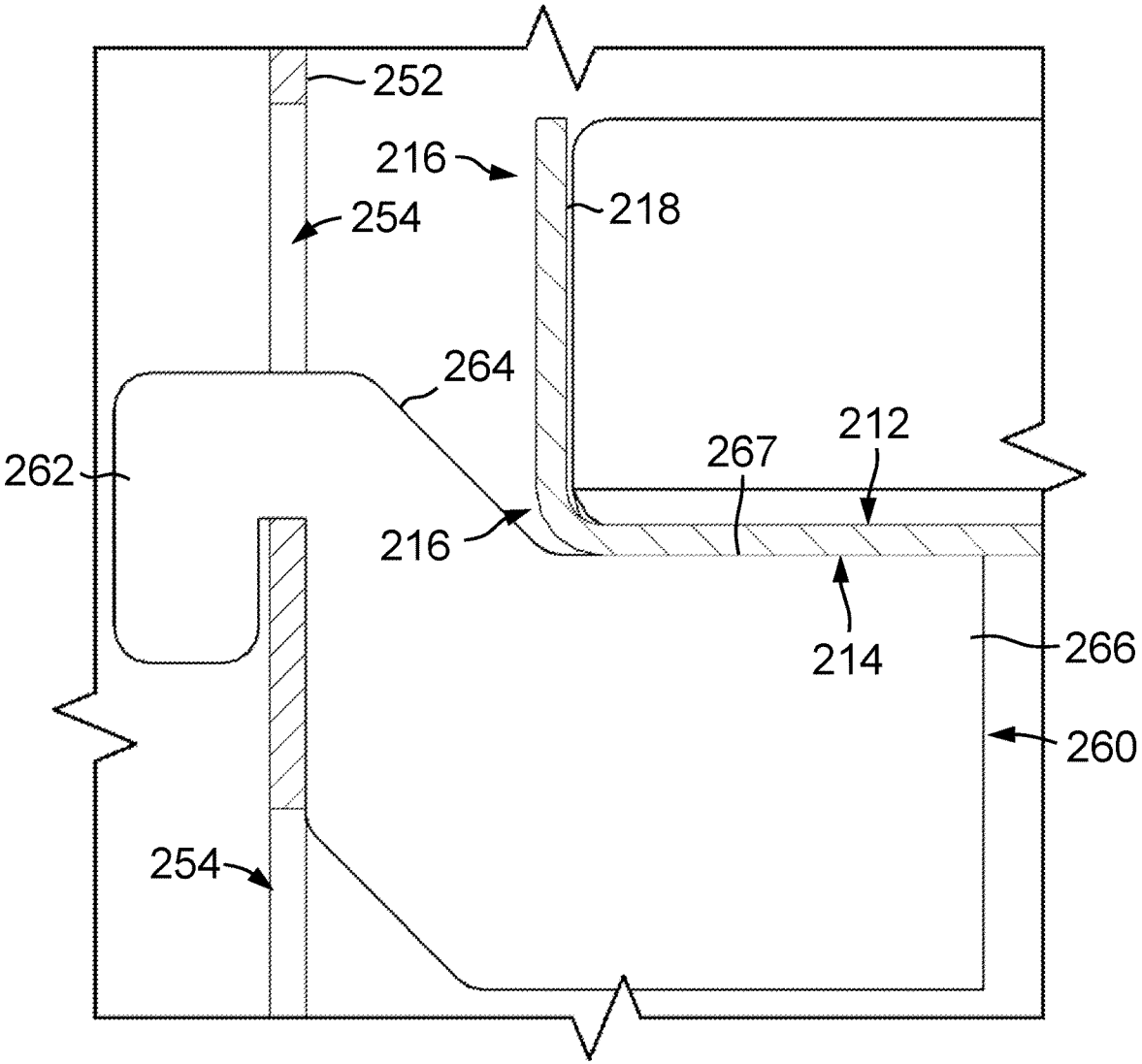
FIGS. 21 and 22 are an enlarged cross-sectional views of the shelf of FIG. 20 supported on one of the brackets of the shelf support assembly of FIG. 18 according to some embodiments disclosed herein.

For instance, as shown in FIG. 21, the ramped surfaces 264 (FIGS. 18 and 19) of each of the brackets 260 may facilitate centering of the shelf 210 in the lateral or horizontal direction between the side walls 135 so that the sides 216 are spaced laterally from the side walls 135 in chamber 12. Thus, if the shelf 210 is inserted off-center between the side walls 135, the bottom side 214 of shelf 210 may engage with the ramped surfaces 264 (e.g., on the corresponding side 216) on the bracket 260 so that the shelf 210 may slide down the ramped surfaces 264 to settle on the upper planar support surface 267 via the force of gravity.

In addition, as shown in FIG. 22, when the shelf 210 is inserted in the chamber 12 and supported on the brackets 260, the saddles 266 of brackets 260 may be received between the pair of centering struts 220. As a result, a slidable range of the shelf 210 in the lateral or horizontal direction between the front opening 13 and back wall 134 is limited due to contact between the centering struts 220 and the saddles 266 of brackets 260. In addition, the front end 210*a* and back end 210*b* of the shelf 210 is spaced (and potentially centered) between the front opening 13 (or the inner surfaces of the inner doors 17 and/or outer door 14) and the back wall 134, respectively, via the engagement between centering struts 220 and saddles 266 of brackets 260.

As previously described, the climate control assembly 100 may include a cascade refrigeration module having a plurality of separate, staged refrigerant circuits 113, 121 that are thermally coupled to one another via the interstage heat exchanger 114 (FIG. 3). The interstage heat exchanger 114 may comprise any suitable heat exchanger type, such as, for instance, shell and tube, double pipe heat exchanger, plate heat exchanger, etc. For instance, FIG. 23 shows an example of the interstage heat exchanger 114 configured as a plate heat exchanger, and specifically a brazed plate heat exchanger according to some embodiments.

Figure 23:
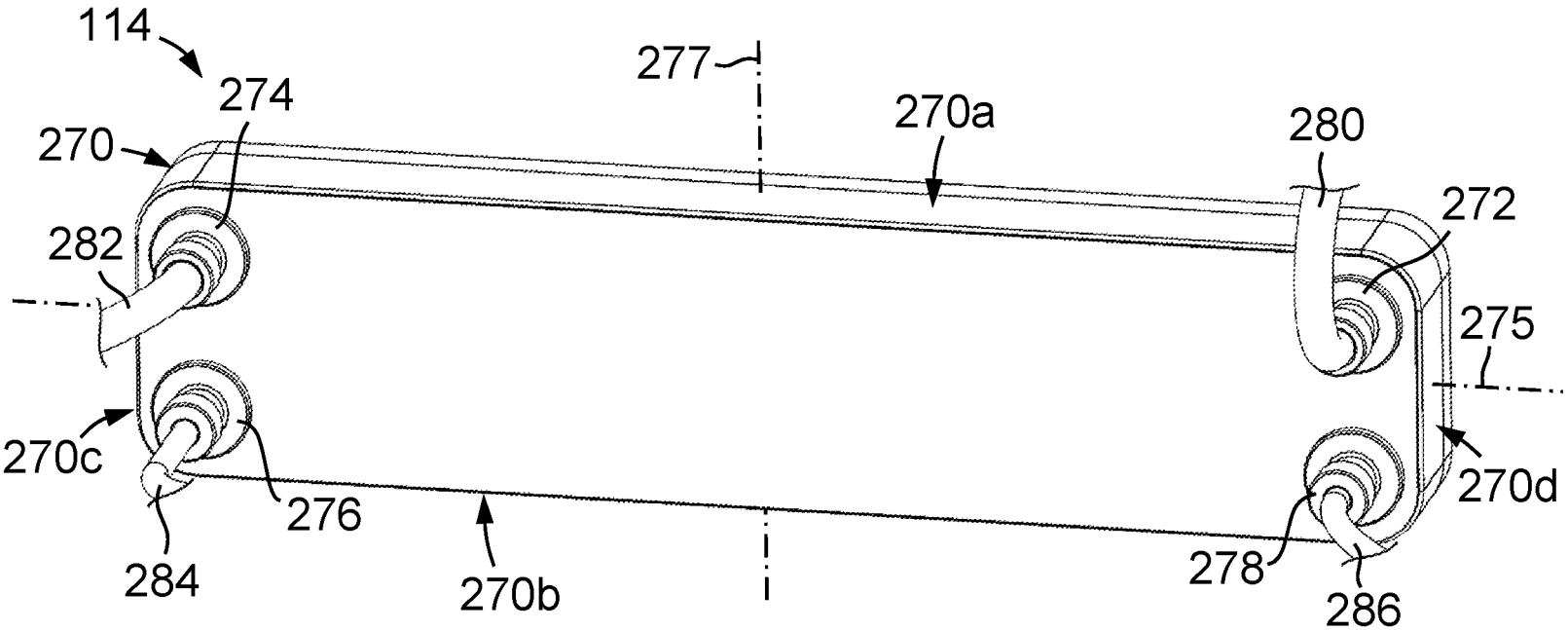
FIG. 23 is a perspective view of an interstage heat exchanger of the climate control assembly of FIG. 4 according to some embodiments disclosed herein.

According to FIG. 23, the interstage heat exchanger 114 includes a generally rectangular shaped housing 270. Specifically, the housing 270 is generally shaped as a rectangular parallelepiped having a first side 270*a*, second side 270*b*, a third side 270*c*, and a fourth side 270*d*. The first side 270*a* and second side 270*b* are spaced from one another along a first axis 275, and the third side 270*c* and fourth side 270*d* are spaced from one another along a second axis 277 that is orthogonal to the first axis 275. The housing 270 are elongated along the first axis 275 relative to the second axis 277 so that the first axis 275 may be referred to as a "major axis," and the second axis 277 may be referred to as a "minor axis." The housing 270 is positioned such that the major axis 275 is generally aligned with the lateral or horizontal direction and the minor axis 277 is generally aligned with the vertical direction. Thus, the first side 270*a* may be referred to as an upper side 270*a*, the second side 270*b* may be referred to as a lower side 270*b*, and the sides 270*c*, 270*d* may be referred to as lateral sides.

The housing 270 includes a first inlet 272, a first outlet 274, a second inlet 276, and a second outlet 278. The first inlet 272 is positioned proximate the intersection of the first side 270*a* and fourth side 270*d*, the first outlet 274 is positioned proximate the intersection of the first side 270*a* and third side 270*c*, the second inlet 276 is positioned proximate the intersection of the third side 270*c* and the second side 270*b*, and the second outlet 278 is positioned proximate intersection of the second side 270*b* and the fourth side 270*d*. Thus, the first inlet 272 and first outlet 274 are axially spaced from one another relative to the major axis 275, and the second inlet 276 and the second outlet 278 are axially spaced from one another relative to the major axis 275. In addition, the first inlet 272 and second outlet 278 are axially spaced from one another relative to the minor axis 277, and the first outlet 274 and second inlet 276 are axially spaced from one another relative to the minor axis 277. As a result, the first inlet 272 and first outlet 274 are positioned vertically above the second outlet 278 and second inlet 276, respectively.

The first inlet 272 and first outlet 274 are in fluid communication with one another via a first fluid circuit (not shown) defined in the housing 270, and the second inlet 276 and second outlet 278 are in fluid communication with one another via a second fluid circuit (not shown) defined in the housing 270. The first fluid circuit (not shown) and the second fluid circuit (not shown) are separate. As a result, the fluids flowing along the first fluid circuit (not shown) and the second fluid circuit (not shown) does not mix or otherwise physically contact one another within the housing 270. However, the first fluid circuit (not shown) and the second fluid circuit (not shown) are in thermal contact with one another through the internal walls or barriers within the housing 270 so that heat may transfer therebetween within the housing 270 during operations.

Referring now to FIGS. 3 and 23, during operations, the first inlet 272, first outlet 274, and first fluid circuit (not shown) is connected as part of the first refrigerant circuit 113 of the refrigeration module 100, and the second inlet 276, second outlet 278, and second fluid circuit (not shown) is connected as part of the second refrigerant circuit 121 of the refrigeration module 100. In particular, the first inlet 272 is connected to a first inlet line 280 that comprises the portion of the first refrigerant circuit 113 that extends from the expansion valve 116 to the interstage heat exchanger 114. In addition, the first outlet 274 is connected to a first outlet line 282 that comprises the portion of the first refrigerant circuit 113 that extends from the interstage heat exchanger 114 to the compressor 112. Further, the second inlet 276 is connected to a second inlet line 284 that comprises the portion of the second refrigerant circuit 121 that extends from the compressor 120 to the interstage heat exchanger 114. Still further, the second outlet 278 is connected to a second outlet line 284 that comprises the portion of the second refrigerant circuit 121 that extends from the interstage heat exchanger 114 to the valve 122.

Thus, during operations, while the first and second fluid circuits (not shown) may take a circuitous or even tortuous path through the housing 270 of interstage heat exchanger 114, the general direction of flow for the first refrigerant in the housing 270 of interstage heat exchanger 114 is from the fourth side 270*d* to the third side 270*c*, and the general direction of flow for the second refrigerant in the housing 270 of the interstage heat exchanger 114 is from the third side 270*c* to the fourth side 270*d*. Accordingly, the first and second refrigerants of the first and second refrigerant circuits 113 and 121, respectively, flow through the housing 270 of interstage heat exchanger 114 in a counter flow arrangement.

As previously described, the first refrigerant of the first refrigerant circuit 113 may change phase (or substantially change phase) from a liquid to a vapor in the interstage heat exchanger 114. Thus, the first refrigerant may be in (or substantially in) a liquid state when flowing into the first inlet 272 via the first inlet line 280, and may be in (or substantially in) a vapor state when flowing out of the first outlet 274 via the first outlet line 282. Conversely, as previously described, the second refrigerant of the second refrigerant circuit 121 may change phase (or substantially change phase) from a vapor to a liquid in the interstage heat exchanger 114. Thus, the second refrigerant may be in (or substantially in) a vapor state when flowing in the second inlet 276 via the second inlet line 284, and may be in (or substantially in) a liquid state when flowing out of the second outlet 278 via the second outlet line 286.

Without being limited to this or any other theory, placing the second inlet 276 and second outlet 278 vertically lower than the first inlet 272 and first outlet 274 may help to ensure a higher concentration of liquid in the second refrigerant exiting the housing 270 via the second outlet 278. Specifically, because the major axis 275 is oriented substantially laterally, and the minor axis 277 is oriented substantially vertically, the second outlet 278 is placed along a vertically lower side of the housing 270. Thus, as second refrigerant condenses to a liquid in the interstage heat exchanger 114, the condensed liquid tends to accumulate in the lower portions of the housing 270 via the force of gravity. In addition, a general momentum of flow of the second refrigerant in the second fluid circuit (not shown) tends to accumulate liquid of the second refrigerant toward the outlet side of the housing 270, which corresponds with the fourth side 270*d* for the second refrigerant as previously described. Thus, placement of the second inlet 276 and second outlet 278 vertically below the first outlet 274 and first inlet 272, respectively, helps to ensure that condensed liquid of the second refrigerant is more highly concentrated at the second outlet 278 so that a reliability and efficiency of the refrigeration module 100 may be enhanced during operations.

In addition, again without being limited to this or any other theory, placing the first inlet 272 and first outlet 274 vertically higher than the second inlet 276 and the second outlet 278 may help to ensure that a higher concentration of vapor in the first refrigerant exiting the housing 270 via the first outlet 274. Specifically, because the major axis 275 is oriented substantially laterally, and the minor axis 277 is oriented substantially vertically, the first outlet 274 is placed along a vertically higher side of the housing 270. Thus, as first refrigerant changes phase to a vapor in the interstage heat exchanger 114, the vapors tend to rise and accumulate in the vertically higher portions of the housing 270. Thus, placement of the first inlet 272 and first outlet 274 vertically above the second outlet 278 and second inlet 276, respectively, helps to ensure that vaporized first refrigerant is more highly concentrated at the first outlet 274 so that a reliability and efficiency of the refrigeration module 100 may be enhanced during operations.

Referring again to FIGS. 1 and 2, a user interface 300 may be mounted to housing 15. Specifically, the user interface 300 may be mounted to the outer door 14 so that a user may easily access the user interface 300 during operations. In some embodiments, the user interface 300 may comprise a user interface of the controller 40 (FIG. 4). Thus, the user interface 300 may be configured to convey information from the controller 40 to a user and/or to receive user inputs for the controller 40 during operations.

Figure 24:
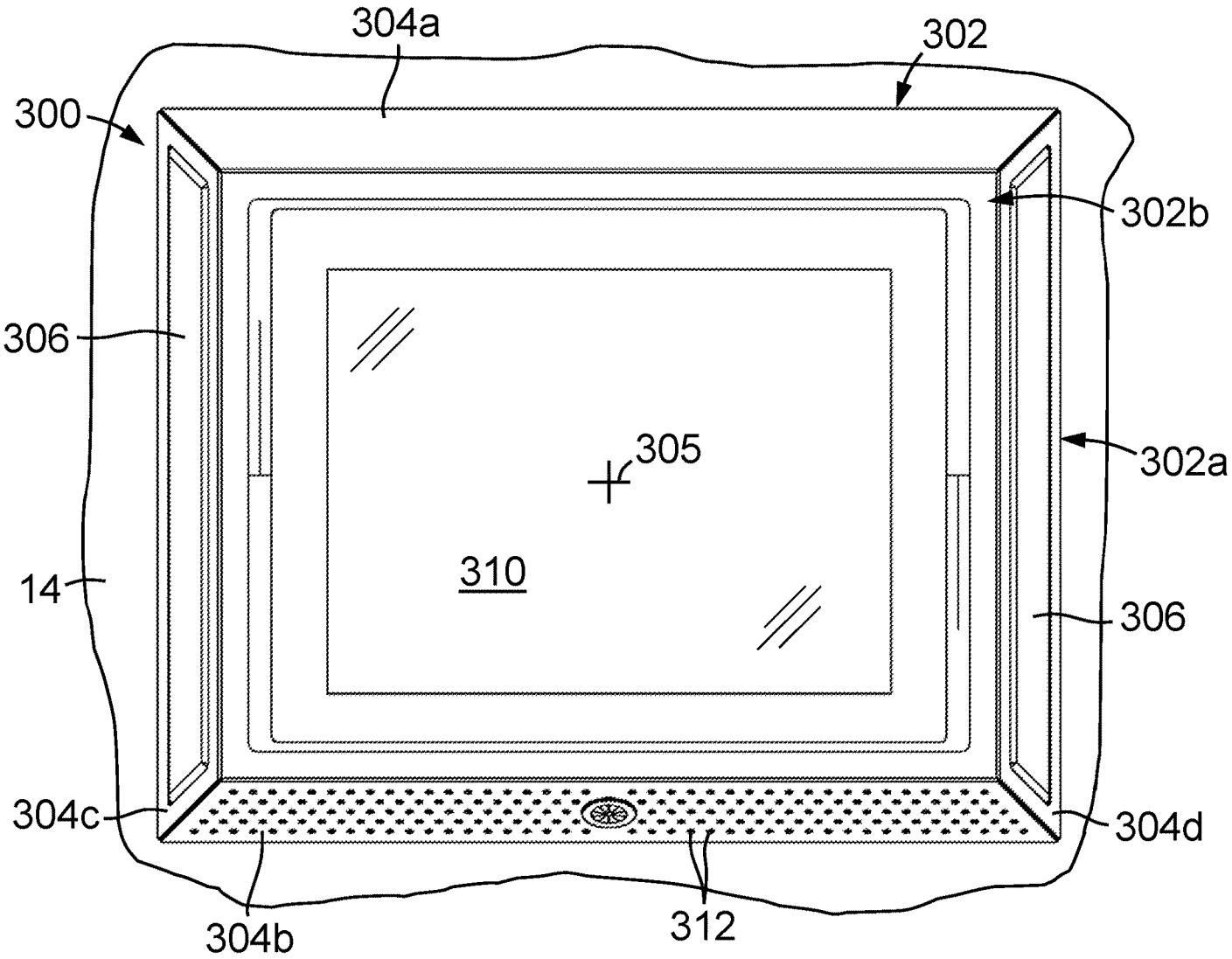
FIG. 24 is a front view of a user interface of the cold storage system of FIG. 1 according to some embodiments disclosed herein.
Figure 25:
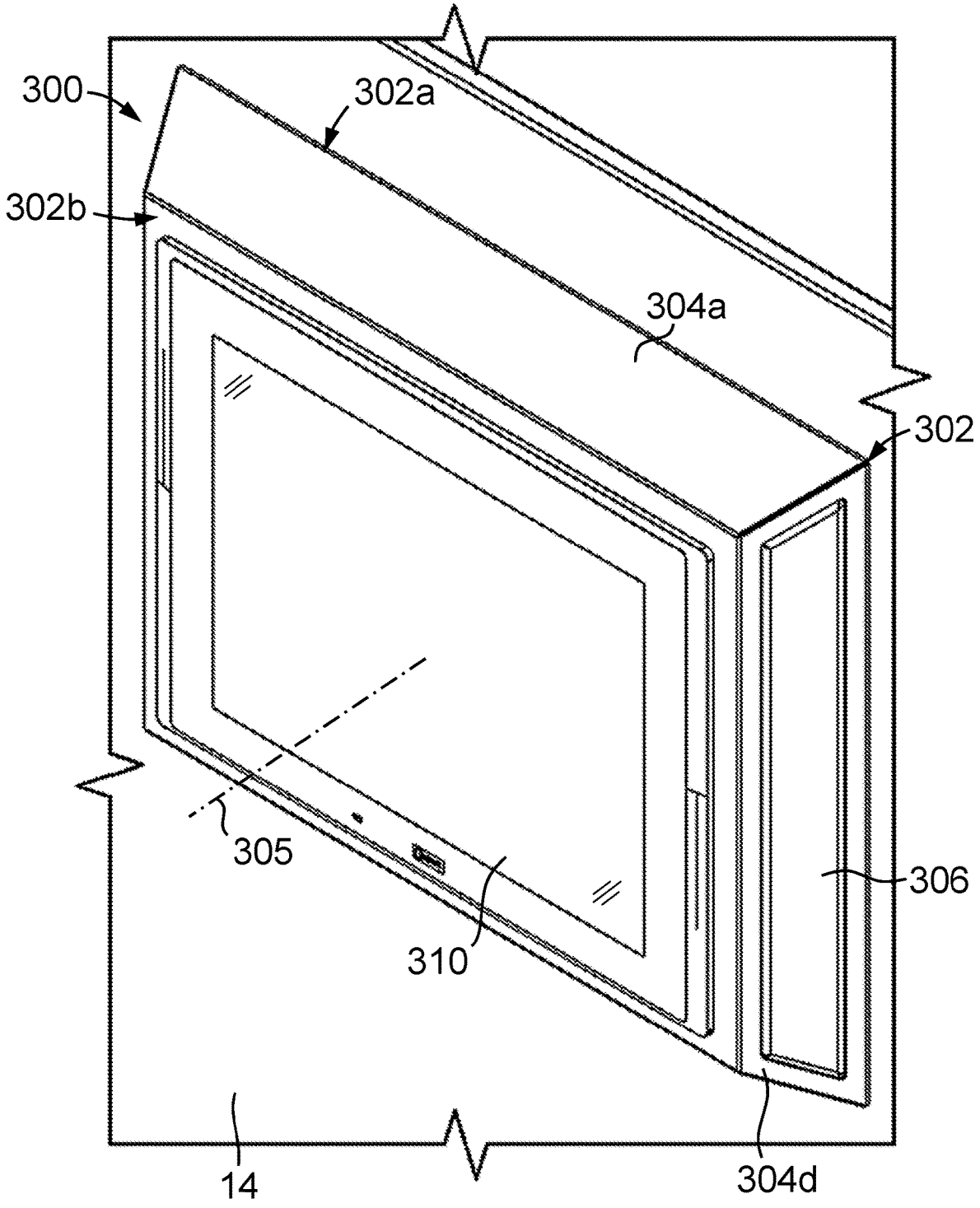
FIG. 25 is a perspective view of the user interface of FIG. 24 according to some embodiments disclosed herein.

Referring now to FIGS. 24 and 25, the user interface 300 may include a housing 302 that projects outward from the outer door 14 along a central axis 305 (or more simply "axis" 305) from a base 302*a* to a terminal end 302*b*. The housing 302 includes a plurality of side surfaces 304*a*, 304*b*, 304*c*, 304*d* that extend from the base 302*a* to the terminal end 302*b*. The housing 302 may have a truncated pyramid shape so that there are a total of four (4) side surfaces 304*a*, 304*b*, 304*c*, 304*d* that taper inward toward the axis 305 when moving from the base 302*a* to the terminal end 302*b*, and each of the side surfaces 304*a*, 304*b*, 304*c*, 304*d* may have a general trapezoidal shape. The housing 302 may be oriented on the outer door 14 so that the side surfaces 304*a*, 304*b*, 304*c*, 304*d* include a top side surface 304*a* positioned along a top side of the housing 302, a bottom side surface 304*b* positioned along a bottom side of the housing 302, and a pair of lateral side surfaces 304*c*, 304*d* that are located on opposed lateral sides of the housing 302 that extend generally vertically between the top side surface 304*a* and bottom side surface 304*b*.

An electronic display 310 may be positioned on the terminal end 302*b* of housing 302 that is configured to present information related to the operation of freezer 10. The electronic display 310 may comprise any suitable type of electronic display (e.g., liquid crystal display, light emitting diode display, plasma display, etc.), and may or may not comprise a touch-sensitive display. During operations, a user may receive information and/or make inputs related to the operation of the freezer 10 via the user interface 300 and particularly the electronic display 310.

One or more of the side surfaces 304*a*, 304*b*, 304*c*, 304*d* may include vents, ports, or other openings that are configured to allow air to flow into and out of the housing 302 for purposes of cooling electronic components contained therein. For instance, in the embodiment shown in FIGS. 23 and 24, the bottom side surface 304*b* includes a plurality of ports 312 arranged thereon.

In addition, as shown in FIGS. 24 and 25, the lateral side surfaces 304*c* and 304*d* may include indicator lights 306 that are configured to emit light so as to visually alert a user to an operational condition of the freezer 10 (or a component thereof). Indicator lights 306 may comprise transparent or translucent covers through which light, may shine through. The indicator lights 306 may utilize any suitable light emitting device(s) or assemblies, such as, for instance, light emitting diodes (LEDs), incandescent lighting devices, etc. In some embodiments, the indicator lights 306 may comprise edge-lit lightguides, where one or more light emitters shine into a peripheral edge of a light guide, and surface imperfections on the light guide (and/or coating(s) or cover (s) that are attached to the light guide via suitable adhesive or mechanical attachments) cause the light to escape and be visible outside of the indicator lights 306. Still other light-emitting systems and/or device(s) are contemplated for the indicator lights 306 in various embodiments.

During operations, the indicator lights 306 may activate or deactivate or may output a particular color and/or pulse of light based on an operational status of the freezer 10 (or component thereof). An operational status of the freezer 10 that may be indicated by the indicator lights 306 may include, among other things, an indication that the refrigeration module 100 is operating or not operating, an indication that there is a system error associated with the freezer 10 (or a component or subsystem thereof, such as the refrigeration module 100), an indication that the outer door 14 is open and/or that the door seal 190 has failed, etc.

In some embodiments, the indicator lights 306 may be configured to output light of different colors, such as green, red, and yellow as an example. In some embodiments, a controller (e.g., such as the controller 40 previously described) may be configured to actuate or energize the indicator lights 306 to emit patterns of colored light in order to indicate a particular operational status of the freezer 10. For instance, in some embodiments, the indicator lights 306 may output patterns of light according to the operational status(es) of freezer 10 shown in Table 1 below.

TABLE 1

| Freezer 10 Operational Status | Indicator Light 306 Pattern |
|---|---|
| Freezer 10 Off | OFF - NO LIGHT |
| Freezer 10 is on and refrigeration module 100 is operating to achieve or maintain a desired temperature in the chamber 12 | GREEN - STEADY |
| Refrigeration module 100 is performing a defrost operation | GREEN to YELLOW FLASH |
| Freezer 10 has a warning condition (e.g., outer door 14 is open, high temperature in chamber 12, etc.) | YELLOW - SLOW FLASH ON (2 s) OFF (1 s) |
| Freezer 10 (or a component thereof) has experienced a failure (e.g., failure of the refrigeration module 100) | RED - Flashing 1 second ON, 1 second OFF |
| Line power failure - freezer 10 running on back-up battery | YELLOW - Flashing on 1 second, off 5 seconds. |
| Back-up battery for freezer 10 has low charge | RED - Flashing on 1 second, off 5 seconds. |

In some embodiments, a controller (e.g., again, the controller 40 in some embodiments) may be configured to actuate or energize the indicator lights 306 to emit combinations of single colors in order to output a range of colors during operations (e.g., such as various combinations of red, green, blue, or other base colors). For instance, in some embodiments, the indicator lights 306 may be configured to output various combinations of red, green, and blue light which may provide up to 16,777,216 different unique output colors, so as to increase a number of unique operational statuses for the freezer 10 that may be visually indicated by the indicator lights 306 during operations. In addition, in some embodiments, the indicator lights 306 may configured to emit pulsing or scanning light emissions (e.g., light that pulses or scans across a length of the indicator light 306 along the corresponding lateral side surfaces 304*c*) so as to indicate one or more operational statuses of the freezer 10.

Regardless as to the specific operational condition or status that is indicated by the indicator lights 306, the use of indicator lights 306 may provide a visual cue to a user who is within sight of the freezer 10 to thereby allow a user to take more immediate action, if necessary or desirable. In addition, the tapered orientation of the lateral side surfaces 304*c*, 304*d* may orient the indicator lights 306 so that they are more easily visible from a greater range of positions relative to the freezer 10 (and particularly the outer door 14). Thus, a user may see the light emitted from the indicator lights 306 from a greater percentage (up to and including 100%) of the room in which the freezer 10 is stored in.

As explained above and reiterated below, the present disclosure includes, without limitation, the following example implementations.

Clause 1: A cold storage system comprising: a housing including: a chamber having a front opening that is closeable by an outer door and a back wall opposite the front opening; one or more outlets defined in the back wall; and one or more inlets defined in the chamber that are more proximate the front opening than the back wall; and a refrigeration module operably coupled to the chamber, the refrigeration module including: an evaporator positioned vertically higher than the chamber; a blower that is configured to generate an airflow that is in thermal communication with the evaporator; and ducting that is configured to circulate the airflow between the chamber and the evaporator via the one or more inlets and the one or more outlets such that the airflow is directed through the one or more outlets into the chamber and then from the chamber into the one or more inlets to cool the chamber.

Clause 2: The cold storage system of any of the clauses, wherein the ducting comprises a suction duct that is configured to direct the airflow from the one or more inlets to the evaporator, the suction duct at least partially formed by a tray that is removably inserted into the chamber from the front opening.

Clause 3: The cold storage system of any of the clauses, further comprising a temperature sensor positioned in the suction duct and mounted to the tray so that withdrawal of the tray from the chamber is configured to expose the temperature sensor, and wherein the refrigeration module includes a controller that is communicatively coupled to the temperature sensor, wherein the controller is configured to control an operating condition of a component of the refrigeration module based at least in part an output from the temperature sensor.

Clause 4: The cold storage system of any of the clauses, wherein the refrigeration module comprises a cascade refrigeration module that includes: a first refrigerant circuit that is configured to circulate a first refrigerant to exchange heat with an ambient environment surrounding the housing; a second refrigerant circuit that is configured to circulate a second refrigerant to exchange heat with the chamber, wherein the evaporator is positioned along the second refrigerant circuit; and an interstage heat exchanger thermally coupled between the first refrigerant circuit and the second refrigerant circuit that is configured to transfer heat between the first refrigerant and the second refrigerant.

Clause 5: The cold storage system of any of the clauses, wherein the refrigeration module is configured to reduce a temperature within the chamber below −50° C. via the airflow.

Clause 6: The cold storage system of any of the clauses, wherein the interstage heat exchanger comprises a brazed plate heat exchanger that includes an elongate body that defines: a first inlet and a first outlet that are connected to the first refrigerant circuit; and a second inlet and a second outlet that are connected to the second refrigerant circuit, wherein the body is oriented substantially horizontally such that: the first inlet and the second outlet are positioned proximate a first lateral side of the body; the second inlet and the first outlet are positioned proximate a second lateral side of the body, the second lateral side being opposite the first lateral side; the second inlet is positioned vertically lower than the first outlet; and the second outlet is positioned vertically lower than the first inlet.

Clause 7: The cold storage system of any of the clauses, wherein the housing further comprises: a door jamb extending around the front opening, the door jamb comprising: a first door stop defining a first seal surface; and a second door stop defining a second seal surface, the second door stop being parallel to and discontinuous from the first door stop such that the first door stop and the second door stop are configured to thermally contract independently of one another.

Clause 8: The cold storage system of any of the clauses, wherein the outer door has a door seal including a plurality of sealing projections that is configured to engage with the door jamb such that a first portion of the sealing projections is configured to engage the first seal surface and a second portion of sealing projections is configured to engage the second seal surface.

Clause 9: The cold storage system of any of the clauses, wherein the first door stop and the second door stop comprise one or more elongate segments, wherein the door jamb further comprises an elongate connecting member arranged between corresponding segments of the first door stop and the second door stop such that the corresponding segments of the first door stop and the second door stop are configured to expand or contract longitudinally relative to the elongate connecting member.

Clause 10: The cold storage system of any of the clauses, wherein the elongate connecting member is engaged between the corresponding segments of the first door stop and the second door stop with tongue-and-groove joints.

Clause 11: The cold storage system of any of the clauses, further comprising a user interface mounted to the outer door, wherein the user interface is projected outward from the outer door such that the user interface includes: a terminal end; a plurality of side surfaces extending between the terminal end and the outer door; an electronic display positioned on the terminal end; and an indicator light positioned on one of the plurality of side surfaces that is configured to emit a light corresponding to an operating condition of the refrigeration module.

Clause 12: The cold storage system of any of the clauses, wherein the chamber includes a pair of side walls extending laterally between the front opening and the back wall, and wherein the cold storage system further comprises: a shelf positioned within the chamber, the shelf including an outer perimeter; and a shelf support positioned in the chamber that is configured to support the shelf so that the outer perimeter is spaced from the pair of side walls, the back wall, and the front opening.

Clause 13: The cold storage system of any of the clauses, wherein the shelf support includes one or more ramped surfaces that are configured to space the outer perimeter of the shelf away from the pair of side walls.

Clause 14: The cold storage system of any of the clauses, wherein the shelf includes a top side and a bottom side opposite the top side, wherein the bottom side includes a pair of centering struts that are configured to engage with the shelf support to space the outer perimeter of the shelf away from the back wall and the front opening within the chamber.

Clause 15: A method comprising: (a) generating an airflow with a blower of a refrigeration module operably coupled to a chamber of a cold storage system; (b) cooling the airflow with an evaporator of the refrigeration module, the evaporator being positioned vertically higher than the chamber; and (c) directing the airflow into the chamber through one or more outlets positioned along a back wall of the chamber, and then out of the chamber through one or more inlets defined in the chamber to cool the chamber, the back wall being opposite a front opening of the chamber, and the one or more inlets being positioned more proximate the front opening than the back wall.

Clause 16: The method of any of the clauses, wherein (c) comprises directing the airflow out of the chamber through the one or more inlets into a suction duct at least partially defined by a tray that is removably inserted into an upper portion of the chamber.

Clause 17: The method of any of the clauses, further comprising: (d) directing the airflow over a temperature sensor that is mounted to the tray; and (e) controlling an operating condition of a component of the refrigeration module based at least in part an output from the temperature sensor.

Clause 18: The method of any of the clauses, further comprising: (f) circulating a first refrigerant in a first refrigerant circuit of the refrigeration module; (g) circulating a second refrigerant in a second refrigerant circuit of the refrigeration module, wherein the evaporator is positioned along the second refrigerant circuit; and (h) exchanging heat between the first refrigerant and the second refrigerant with an interstage heat exchanger.

Clause 19: The method of any of the clauses, wherein the interstage heat exchanger comprises a brazed plate, and wherein (h) comprises: (h1) flowing the first refrigerant laterally between a first inlet and a first outlet in the interstage heat exchanger; and (h2) flowing the second refrigerant laterally between a second inlet and a second outlet in the interstage heat exchanger, the second inlet and second outlet being positioned vertically lower than the first outlet and the first inlet, respectively.

Clause 20: The method of any of the clauses, further comprising: (i) sealing the front opening of the chamber by engaging a door seal on an outer door with a door jamb positioned around the front opening to seal the chamber from a surrounding environment, wherein the door jamb includes: a first door stop defining a first seal surface; and a second door stop defining a second seal surface, the second door stop being parallel to and discontinuous from the first door stop such that the first door stop and the second door stop are configured to thermally contract independently of one another.

Clause 21: The method of any of the clauses, wherein the door seal includes a plurality of sealing projections, and wherein (i) further comprises: (i1) engaging a first portion of the plurality of sealing projections with the first seal surface; and (i2) engaging a second portion of the plurality of sealing projections with the second seal surface.

Clause 22: The method of any of the clauses, wherein the chamber includes a pair of side walls extending laterally between the front opening and the back wall, and wherein the method further comprises centering a shelf in the chamber with a shelf support such that an outer perimeter of the shelf is spaced from the pair of side walls, the back wall, and the front opening.

Clause 23: A cold storage system comprising: a housing including: a chamber having a front opening; a door jamb extending around the front opening, the door jamb comprising: a first door stop defining a first seal surface; and a second door stop defining a second seal surface that is adjacent to the first seal surface along an edge of the front opening, the second door stop being parallel to and discontinuous from the first door stop such that the first door stop and the second door stop are configured to thermally contract independently of one another; a refrigeration module that is configured to generate an airflow through the chamber to reduce a temperature of the chamber below −50° C.; and an outer door that is configured to selectively close the front opening, the outer door having a door seal including a plurality of sealing projections that is configured to engage with the door jamb such that a first portion of the sealing projections is configured to engage the first door stop and a second portion of sealing projections is configured to engage the second door stop.

Clause 24: The cold storage system of any of the clauses, wherein the first door stop and the second door stop each comprise one or more elongate segments, wherein the door jamb further comprises an elongate connecting member connected between corresponding segments of the first door stop and the second door stop such that the corresponding segments of the first door stop and the second door stop are configured to expand or contract longitudinally relative to the elongate connecting member.

Clause 25: The cold storage system of any of the clauses, wherein the elongate connecting member is engaged between the first door stop and the second door stop with tongue-and-groove joints.

Clause 26: The cold storage system of any of the clauses, further comprising ducting that is configured to direct the airflow into the chamber via one or more outlets positioned on a back wall of the chamber, and out of the chamber via one or more inlets positioned more proximate the front opening than the back wall within the chamber.

Clause 27: The cold storage system of any of the clauses, wherein the one or more inlets are formed in a tray that is removably inserted into an upper portion of the chamber.

Clause 28: The cold storage system of any of the clauses, wherein the tray at least partially defines a suction duct of the ducting.

Clause 29: The cold storage system of any of the clauses, wherein the refrigeration module includes an evaporator that is configured to cool the airflow, wherein the evaporator is positioned vertically higher than the chamber in the housing.

Clause 30: The cold storage system of any of the clauses, further comprising a temperature sensor positioned in the suction duct and mounted to the tray so that withdrawal of the tray from the chamber is configured to expose the temperature sensor, wherein the refrigeration module includes a controller that is communicatively coupled to the temperature sensor, and wherein the controller is configured to control an operating condition of a component of the refrigeration module based at least in part an output from the temperature sensor.

Clause 31: The cold storage system of any of the clauses, further comprising a user interface mounted to the outer door, wherein the user interface is projected outward from the outer door such that the user interface includes: a terminal end; a plurality of side surfaces extending between the terminal end and the outer door; an electronic display positioned on the terminal end; and an indicator light positioned on one of the plurality of side surfaces that is configured to emit a light corresponding to an operating condition of the refrigeration module.

Clause 32: The cold storage system of any of the clauses, wherein the chamber includes a pair of side walls extending laterally between the front opening and the back wall, wherein the system further comprises: a shelf positioned within the chamber, the shelf including an outer perimeter; and a shelf support positioned in the chamber that is configured to support the shelf so that the outer perimeter is spaced from the pair of side walls, the back wall, and the front opening.

Clause 33: The cold storage system of any of the clauses, wherein the shelf support includes one or more ramped surfaces that are configured to space the outer perimeter of the shelf away from the pair of side walls, wherein the shelf includes a top side and a bottom side opposite the top side, and wherein the bottom side includes a pair of centering struts that are configured to engage with the shelf support to space the outer perimeter of the shelf away from the back wall and the front opening within the chamber.

Clause 34: A method comprising: (a) engaging a first seal surface of a first door stop of a door jamb extending at least partially around a front opening of a chamber of a cold storage system with a first portion of a plurality of sealing projections of a door seal coupled to an outer door; (b) engaging a second seal surface of a second door stop of the door jamb with a second portion of the plurality of sealing projections of the door seal, the second door stop being parallel to and adjacent the first door stop along an edge of the front opening, and the second door stop being discontinuous from the first door stop such that the first door stop and the second door stop are configured to thermally contract independently of one another; and (c) directing an airflow from a refrigeration module and through the chamber to cool the chamber below −50° C.

Clause 35: The method of any of the clauses, wherein the first door stop and the second door stop each include one or more elongate segments, wherein the door jamb further comprises an elongate connecting member connected between corresponding segments of the first door stop and the second door stop, and wherein the method further comprises: (d) contracting a segment of the first door stop longitudinally; and (e) sliding the segment of the first door stop along the connecting member during (d).

Clause 36: The method of any of the clauses, wherein the corresponding segments of the first door stop and the second door stop are connected to the connecting member via tongue-and-groove joints.

Clause 37: The method of any of the clauses, wherein (c) further comprises: directing the airflow into the chamber through one or more outlets positioned along a back wall of the chamber, and then out of the chamber through one or more inlets defined in the chamber, the back wall being opposite the front opening of the chamber, and the one or more inlets being positioned more proximate the front opening than the back wall.

Clause 38: The method of any of the clauses, further comprising: (f) flowing the airflow past an inner side of the door seal during (e); and (g) contacting an outer side of the door seal with an ambient environment during (e).

Clause 39: The method of any of the clauses, wherein (c) further comprises flowing at least a portion of the airflow vertically around an outer perimeter of a shelf that is positioned in the chamber.

Clause 40: The method of any of the clauses, further comprising: (h) circulating a first refrigerant in a first refrigerant circuit of the refrigeration module; (i) circulating a second refrigerant in a second refrigerant circuit of the refrigeration module to cool the airflow, wherein the second refrigerant circuit includes an evaporator positioned vertically higher than the chamber that is configured to cool the airflow; and (h) exchanging heat between the first refrigerant and the second refrigerant with an interstage heat exchanger.

Clause 41: A cold storage system comprising: a housing including: a chamber having a front opening that is closeable by an outer door and a back wall opposite the front opening; one or more outlets defined in the back wall; a suction duct having one or more inlets defined therein that is positioned in an upper portion of the chamber, the suction duct at least partially formed by a tray that is removably inserted into the chamber from the front opening; and a refrigeration module operably coupled to the chamber, the refrigeration module configured to generate an airflow that is directed out of the one or more outlets into the chamber and then from the chamber into the one or more inlets of the suction duct to cool the chamber below −50° C.

Clause 42: The cold storage system of any of the clauses, further comprising a temperature sensor positioned in the suction duct and mounted to the tray so that withdrawal of the tray from the front opening of the chamber is configured to expose the temperature sensor outside of the chamber, wherein the refrigeration module includes a controller that is communicatively coupled to the temperature sensor, and wherein the controller is configured to control an operating condition of a component of the refrigeration module based at least in part an output from the temperature sensor.

Clause 43: The cold storage system of any of the clauses, wherein the refrigeration module comprises an evaporator that is configured to reduce a temperature of the airflow, and wherein the evaporator is positioned vertically higher than the chamber.

Clause 44: The cold storage system of any of the clauses, wherein the refrigeration module includes: a first refrigerant circuit that is configured to circulate a first refrigerant to exchange heat with an ambient environment surrounding the housing; a second refrigerant circuit that is configured to circulate a second refrigerant to exchange heat with the chamber, wherein the evaporator is positioned along the second refrigerant circuit; and an interstage heat exchanger thermally coupled between the first refrigerant circuit and the second refrigerant circuit that is configured to transfer heat between the first refrigerant and the second refrigerant.

Clause 45: The cold storage system of any of the clauses, wherein the interstage heat exchanger comprises a brazed plate heat exchanger that includes an elongate body that defines: a first inlet and a first outlet that are connected to the first refrigerant circuit; and a second inlet and a second outlet that are connected to the second refrigerant circuit, wherein the body is oriented substantially horizontally such that: the first inlet and the second outlet are positioned proximate a first lateral side of the body; the second inlet and the first outlet are positioned proximate a second lateral side of the body, the second lateral side being opposite the first lateral side; the second inlet is positioned vertically lower than the first outlet; and the second outlet is positioned vertically lower than the first inlet.

Clause 46: The cold storage system of any of the clauses, wherein the housing further comprises: a door jamb extending at least partially around the front opening, the door jamb comprising: a first door stop defining a first seal surface; and a second door stop defining a second seal surface, the second door stop being parallel to and discontinuous from the first door stop such that the first door stop and the second door stop are configured to thermally contract independently of one another.

Clause 47: The cold storage system of any of the clauses, wherein the outer door has a door seal including a plurality of sealing projections that is configured to engage with the door jamb such that a first portion of the plurality of sealing projections is configured to engage the first seal surface and a second portion of the plurality of sealing projections is configured to engage the second seal surface.

Clause 48: The cold storage system of any of the clauses, further comprising a user interface mounted to the outer door, wherein the user interface is projected outward from the outer door such that the user interface includes: a terminal end; a plurality of side surfaces extending between the terminal end and the outer door; an electronic display positioned on the terminal end; and an indicator light positioned on one of the plurality of side surfaces that is configured to emit a light corresponding to an operating condition of the refrigeration module.

Clause 49: The cold storage system of any of the clauses, wherein the plurality of side surfaces taper inward when extending outward from the outer door to the terminal end.

Clause 50: The cold storage system of any of the clauses, wherein the interface assembly has a truncated pyramid shape such that the plurality of side surfaces have a trapezoidal shape.

Clause 51: The cold storage system of any of the clauses, wherein the chamber includes a pair of side walls extending laterally between the front opening and the back wall, wherein the system further comprises: a shelf positioned within the chamber, the shelf including an outer perimeter; and a shelf support positioned in the chamber that is configured to support the shelf so that the outer perimeter is spaced from the pair of side walls, the back wall, and the front opening.

Clause 52: The cold storage system of any of the clauses, wherein the shelf support includes one or more ramped surfaces that are configured to space the outer perimeter of the shelf away from the pair of side walls, and wherein the shelf includes a top side and a bottom side opposite the top side, and wherein the bottom side includes a pair of centering struts that are configured to engage with the shelf support to space the outer perimeter of the shelf away from the back wall and the front opening within the chamber.

Clause 53: A method comprising: (a) inserting a tray into an upper portion of a chamber of a cold storage system to at least partially define a suction duct in the chamber, the tray having one or more inlets defined therein that are configured to place the chamber in fluid communication with the suction duct, and the chamber including a back wall having one or more outlets defined therein; and (b) operably coupling a refrigeration module to the chamber, the refrigeration module having a blower and an evaporator arranged such that the blower is configured to generate an airflow from the evaporator and into the chamber via the one or more outlets, and then from the chamber to the suction duct via the one or more inlets to cool the chamber below −50° C.

Clause 54: The method of any of the clauses, further comprising: (c) controlling an operating condition of a component of the refrigeration module based at least in part on an output of a temperature sensor that is positioned in the suction duct and mounted to the tray.

Clause 55: The method of any of the clauses, further comprising: (d) withdrawing the tray from a front opening of the chamber; and (e) exposing the temperature sensor outside of the chamber as result of (d).

Clause 56: The method of any of the clauses, wherein the one or more inlets are more proximate the front opening than the back wall.

Clause 57: The method of any of the clauses, further comprising: (f) circulating a first refrigerant in a first refrigerant circuit of the refrigeration module; (g) circulating a second refrigerant in a second refrigerant circuit of the refrigeration module, wherein the evaporator is positioned along the second refrigerant circuit; and (h) exchanging heat between the first refrigerant and the second refrigerant with an interstage heat exchanger.

Clause 58: The method of any of the clauses, wherein the evaporator is positioned vertically higher than the chamber.

The embodiments disclosed herein are directed to cold storage systems that utilize forced air convection in an internal chamber to achieve and maintain low temperatures (e.g., such as ultra-low temperatures) for products stored therein. In some embodiments, the cold storage systems may utilize forced convection, via a refrigerated airflow through the chamber, to achieve and/or maintain the desired temperature therein. In some embodiments, the refrigeration system of the cold storage system may be configured and positioned to harness the upward flow of natural heat convection in the chamber so as to achieve enhanced operational efficiencies. In some embodiments, the cold storage systems may include enhanced door seals that are configured to withstand an extreme temperature difference between the interior of the cold chamber and the surrounding ambient environment, thereby also further enhancing performance and operational efficiency. In some embodiments, the cold storage systems may include alternative or additional features that may further increase reliability, performance, and/or efficiency thereof during operations. Thus, through use of embodiments disclosed herein, a cold storage system may more consistently and reliably achieve and maintain a desired temperature for stored products, which may be particularly important for degradable materials such as life science products.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cold storage system comprising:

a housing including:

a chamber having a front opening that is closeable by an outer door and a back wall opposite the front opening;

one or more outlets defined in the back wall;

one or more inlets defined in the chamber that are more proximate the front opening than the back wall;

a door jamb extending around the front opening, the door jamb comprising:

a first door stop defining a first seal surface; and a second door stop defining a second seal surface, the second door stop being parallel to and discontinuous from the first door stop such that the first door stop and the second door stop are configured to thermally contract independently of one another, wherein the first door stop and the second door stop comprise one or more elongate segments, and wherein the door jamb further comprises an elongate connecting member arranged between corresponding segments of the first door stop and the second door stop such that the corresponding segments of the first door stop and the second door stop are configured to expand or contract longitudinally relative to the elongate connecting member; and a refrigeration module operably coupled to the chamber, the refrigeration module including:

an evaporator positioned vertically higher than the chamber;

a blower that is configured to generate an airflow that is in thermal communication with the evaporator; and ducting that is configured to circulate the airflow between the chamber and the evaporator via the one or more inlets and the one or more outlets such that the airflow is directed through the one or more outlets into the chamber and then from the chamber into the one or more inlets to cool the chamber.

2. The cold storage system of claim 1, wherein the ducting comprises a suction duct that is configured to direct the airflow from the one or more inlets to the evaporator, the suction duct at least partially formed by a tray that is removably inserted into the chamber from the front opening.

3. The cold storage system of claim 2, further comprising a temperature sensor positioned in the suction duct and mounted to the tray so that withdrawal of the tray from the chamber is configured to expose the temperature sensor, and wherein the refrigeration module includes a controller that is communicatively coupled to the temperature sensor, wherein the controller is configured to control an operating condition of a component of the refrigeration module based at least in part on an output from the temperature sensor.

4. The cold storage system of claim 1, wherein the refrigeration module comprises a cascade refrigeration module that includes:

a first refrigerant circuit that is configured to circulate a first refrigerant to exchange heat with an ambient environment surrounding the housing;

a second refrigerant circuit that is configured to circulate a second refrigerant to exchange heat with the chamber, wherein the evaporator is positioned along the second refrigerant circuit; and an interstage heat exchanger thermally coupled between the first refrigerant circuit and the second refrigerant circuit that is configured to transfer heat between the first refrigerant and the second refrigerant.

5. The cold storage system of claim 4, wherein the refrigeration module is configured to reduce a temperature within the chamber below −50□C via the airflow.

6. The cold storage system of claim 4, wherein the interstage heat exchanger comprises a brazed plate heat exchanger that includes an elongate body that defines:

a first inlet and a first outlet that are connected to the first refrigerant circuit; and a second inlet and a second outlet that are connected to the second refrigerant circuit, wherein the body is oriented substantially horizontally such that:

the first inlet and the second outlet are positioned proximate a first lateral side of the body;

the second inlet and the first outlet are positioned proximate a second lateral side of the body, the second lateral side being opposite the first lateral side;

the second inlet is positioned vertically lower than the first outlet; and the second outlet is positioned vertically lower than the first inlet.

7. The cold storage system of claim 1, wherein the outer door has a door seal including a plurality of sealing projections that is configured to engage with the door jamb such that a first portion of the sealing projections is configured to engage the first seal surface and a second portion of sealing projections is configured to engage the second seal surface.

8. The cold storage system of claim 1, wherein the elongate connecting member is engaged between the corresponding segments of the first door stop and the second door stop with tongue-and-groove joints.

9. The cold storage system of claim 1, further comprising a user interface mounted to the outer door, wherein the user interface is projected outward from the outer door such that the user interface includes:

a terminal end;

a plurality of side surfaces extending between the terminal end and the outer door;

an electronic display positioned on the terminal end; and an indicator light positioned on one of the plurality of side surfaces that is configured to emit a light corresponding to an operating condition of the refrigeration module.

10. The cold storage system of claim 1, wherein the chamber includes a pair of side walls extending laterally between the front opening and the back wall, and wherein the cold storage system further comprises:

a shelf positioned within the chamber, the shelf including an outer perimeter; and a shelf support positioned in the chamber that is configured to support the shelf so that the outer perimeter is spaced from the pair of side walls, the back wall, and the front opening.

11. The cold storage system of claim 10, wherein the shelf support includes one or more ramped surfaces that are configured to space the outer perimeter of the shelf away from the pair of side walls.

12. The cold storage system of claim 11, wherein the shelf includes a top side and a bottom side opposite the top side, wherein the bottom side includes a pair of centering struts that are configured to engage with the shelf support to space the outer perimeter of the shelf away from the back wall and the front opening within the chamber.

13. A method comprising:

(a) generating an airflow with a blower of a refrigeration module operably coupled to a chamber of a cold storage system;

(b) cooling the airflow with an evaporator of the refrigeration module, the evaporator being positioned vertically higher than the chamber;

(c) directing the airflow into the chamber through one or more outlets positioned along a back wall of the chamber, and then out of the chamber through one or more inlets defined in the chamber to cool the chamber, the back wall being opposite a front opening of the chamber, and the one or more inlets being positioned more proximate the front opening than the back wall; and (d) sealing the front opening of the chamber by engaging a door seal on an outer door with a door jamb positioned around the front opening to seal the chamber from a surrounding environment, wherein the door jamb includes:

a first door stop defining a first seal surface; and a second door stop defining a second seal surface, the second door stop being parallel to and discontinuous from the first door stop such that the first door stop and the second door stop are configured to thermally contract independently of one another wherein the first door stop and the second door stop comprise one or more elongate segments, and wherein the door jamb further comprises an elongate connecting member arranged between corresponding segments of the first door stop and the second door stop such that the corresponding segments of the first door stop and the second door stop are configured to expand or contract longitudinally relative to the elongate connecting member.

14. The method of claim 13, wherein (c) comprises directing the airflow out of the chamber through the one or more inlets into a suction duct at least partially defined by a tray that is removably inserted into an upper portion of the chamber.

15. The method of claim 14, further comprising:

(e) directing the airflow over a temperature sensor that is mounted to the tray; and (f) controlling an operating condition of a component of the refrigeration module based at least in part an output from the temperature sensor.

16. The method of claim 13, further comprising:

(g) circulating a first refrigerant in a first refrigerant circuit of the refrigeration module;

(h) circulating a second refrigerant in a second refrigerant circuit of the refrigeration module, wherein the evaporator is positioned along the second refrigerant circuit; and (i) exchanging heat between the first refrigerant and the second refrigerant with an interstage heat exchanger.

17. The method of claim 16, wherein the interstage heat exchanger comprises a brazed plate, and wherein (i) comprises:

(i1) flowing the first refrigerant laterally between a first inlet and a first outlet in the interstage heat exchanger; and (i2) flowing the second refrigerant laterally between a second inlet and a second outlet in the interstage heat exchanger, the second inlet and second outlet being positioned vertically lower than the first outlet and the first inlet, respectively.

18. The method of claim 13, wherein the door seal includes a plurality of sealing projections, and wherein (d) further comprises:

(d1) engaging a first portion of the plurality of sealing projections with the first seal surface; and (d2) engaging a second portion of the plurality of sealing projections with the second seal surface.

19. The method of claim 13, wherein the chamber includes a pair of side walls extending laterally between the front opening and the back wall, and wherein the method further comprises centering a shelf in the chamber with a shelf support such that an outer perimeter of the shelf is spaced from the pair of side walls, the back wall, and the front opening.

* * * * *